US008451084B2

(12) United States Patent
Huang et al.

(10) Patent No.: US 8,451,084 B2
(45) Date of Patent: May 28, 2013

(54) LAMINATED SURFACE MOUNTING TYPE THERMISTOR AND MANUFACTURING METHOD THEREOF

(75) Inventors: Jinhua Huang, Shanghai (CN); Pengxing Wang, Shanghai (CN); Qingguo Gong, Shanghai (CN); Yuzheng Shi, Shanghai (CN); Jiangquan Liao, Shanghai (CN)

(73) Assignee: Shanghai Keter Polymer Material Co., Ltd., Shanghai (CN)

( * ) Notice: Subject to any disclaimer, the term of this patent is extended or adjusted under 35 U.S.C. 154(b) by 0 days.

(21) Appl. No.: 13/145,040

(22) PCT Filed: Jun. 29, 2009

(86) PCT No.: PCT/CN2009/072497

§ 371 (c)(1),
(2), (4) Date: Mar. 13, 2012

(87) PCT Pub. No.: WO2010/081312

PCT Pub. Date: Jul. 22, 2010

(65) Prior Publication Data

US 2011/0273264 A1 Nov. 10, 2011

(30) Foreign Application Priority Data

Jan. 16, 2009 (CN) ..... 2009 1 0045482
Mar. 13, 2009 (CN) ..... 2009 2 0068781 U

(51) Int. Cl.
*H01C 7/10* (2006.01)

(52) U.S. Cl.
USPC ..... 338/22 R; 338/20; 338/332

(58) Field of Classification Search
USPC ..... 338/22 R
See application file for complete search history.

(56) References Cited

U.S. PATENT DOCUMENTS

| | | | | |
|---|---|---|---|---|
| 5,831,510 | A * | 11/1998 | Zhang et al. | 338/22 R |
| 5,900,800 | A | 5/1999 | McGuire et al. | |
| 5,907,272 | A * | 5/1999 | McGuire | 338/22 R |
| 6,172,591 | B1 * | 1/2001 | Barrett | 338/22 R |
| 6,480,094 | B1 * | 11/2002 | Chen et al. | 338/328 |

FOREIGN PATENT DOCUMENTS

| | | | |
|---|---|---|---|
| CN | 1291775 | A | 4/2001 |
| CN | 1342322 | A | 3/2002 |
| CN | 2569298 | Y | 8/2003 |
| CN | 1447351 | A | 10/2003 |
| CN | 2591719 | Y | 12/2003 |
| JP | 1-293503 | A | 11/1989 |

* cited by examiner

*Primary Examiner* — Kyung Lee
(74) *Attorney, Agent, or Firm* — Rabin & Berdo, P.C.

(57) ABSTRACT

A laminated SMD-type thermistor has a conductive module, a left and a right conductive metal layer. The conductive module includes a core conductive module coated with an insulating layer on the upper and lower surface, and the left and right side. The core conductive module includes at least one conductive unit piled up in sequence, two conductive units are separated by an insulating material layer. The conductive unit includes an upper metal foil, a conductive polymer chip and a lower metal foil which are laminated in sequence from top to bottom. A left and right conductive metal layer are coated on the left and right part of the conductive module respectively, and penetrate the insulating layer partially, to connect with two metal foils of the conductive unit respectively. The laminated SMD-type thermistor can further comprise two plating resistant films coated on the upper and lower surface of the conductive module.

24 Claims, 14 Drawing Sheets

LAMINATED SURFACE MOUNTING TYPE THERMISTOR AND MANUFACTURING METHOD THEREOF

FIELD OF TECHNOLOGY

The present invention relates to the field of thermistors, more particularly, to the field of SMD (Surface Mounted Device)-type thermistors, especially, to laminated SMD-type thermistors and manufacturing methods thereof.

DESCRIPTION OF RELATED ARTS

Thermistors with positive temperature coefficient (PTC) property have been used widely in the circuit protection of the field of 6C industries such as computers, communications, consumer electronics, cars, closed circuits, digital contents and so on. Their working principle is that: when the circuit works properly, the value R0 of the PTC thermistor is very small and does not hinder the passage of the current; and when the circuit has failures such as overcurrent, overload or overheat, the surface temperature of the thermistor rises rapidly, when it rises over the switch temperature, the thermistor rises to a high impedance state instantly, so as to limit the circuit current timely to a very low level to protect the circuit; when the failures are recovered, the PTC thermistor is cooled quickly to restore to the original low resistance state, after the circuit return to be normal, the thermistor can be reused again.

In the field of manufacturing high-density circuits of the 6C industries, electronic components need to meet the surface mounted requirement, therefore, surface mounting of PTC thermistor elements has become a development trendency. Because of the requirements to the initial resistance value R0 and other properties (such as the current characteristics, voltage-current characteristics, etc.), the laminated (i.e. "two or more layers of PTC thermistor chips", which is referred to as "laminated" hereinafter) form has been adopted sometimes in the structural design. However, the current laminated SMD-type thermistors with PTC property have some defects both in design and manufacturing, and the structure designs and the manufacturing processes of the prior laminated SMD-type thermistors with PTC property will be illuminated hereinafter.

The techniques published previously (such as the published specifications of Chinese patent applications CN 1291775A, CN 2569298Y, CN 2591719Y, etc.) disclosed that when various SMD-type thermistors with PTC property were manufactured, the etching process of the surface metal foil was carried out inevitably, and the etching process now adopts the chemical etching method commonly. But the chemical etching method has inherent shortcomings in technologies, firstly, the etching solution used in the process has a severe pollution to the environment, and also has relatively great harm to human bodies and mechanical equipments; secondly, the open accuracy of the process is relatively low, thus the rate of finished products is relatively low; thirdly, it is easy for the subsequent procedure after the etching process to make the etching pattern produce abnormal phenomena such as shift, dislocation and so on, making the process unstable. In addition, in the structures of various SMD-type thermistors with PTC property published previously, the etching areas are formed by etching on the upper and lower surfaces of the metal foil, thus affecting its effective usable area, and when it is welded to the circuit board, it is possible that the welding position deviation may cause short-circuit.

At the same time, in various SMD-type thermistors with PTC property disclosed in the prior art (such as the Chinese Publication Numbers CN 2591719Y, etc.), there are inevitably the following disadvantages in their structures and in the manufacturing processes:

(1) There are too many materials (resistance chip with PTC property, metal foil, plating resistant film, insulating film, surface metal layer, etc.) required in forming the element, which makes the total cost of the raw materials relatively high;

(2) For there are too many materials, the procedure required is complicated, making the total rate of finished products relatively low;

(3) For there are too many materials, when the processes such as heat processing and so on are performed, it is easy for the pattern layer to produce abnormal phenomena such as shift, dislocation and so on, thus making the process unstable.

Therefore, there is a need to provide a SMD-type thermistor structure, which has a low cost, a high yield rate, no etching and a superior performance, and is environmentally-friendly, and the corresponding manufacturing method.

SUMMARY OF THE INVENTION

Aspects of the present invention generally pertain to provide a laminated SMD-type thermistor and manufacturing method thereof, the laminated SMD-type thermistor has a superior performance and a high rate of qualified products, its manufacturing method has a unique process, no etching, a greatly reduced cost, a sable process, a high accuracy and a high yield rate, and is environmentally-friendly.

In order to realize the above aims, the laminated SMD-type thermistor and manufacturing method thereof of the present invention are provided as follows:

In a first aspect of the present invention, a laminated SMD-type thermistor is provided, and comprises a conductive module, a left conductive metal layer and a right conductive metal layer, the conductive module includes a core conductive module and an insulating layer which is coated on the upper surface, the lower surface, the left side and the right side of the core conductive module, the core conductive module includes a conductive unit which includes an upper metal foil, a conductive polymer chip with PTC property and a lower metal foil which are laminated in sequence from top to bottom, the left conductive metal layer and the right conductive metal layer are coated on the left part and the right part of the conductive module respectively, and penetrate the insulating layer partially, so as to be connected with the upper metal foil/the lower metal foil and the lower metal foil/the upper metal foil of the conductive unit respectively.

In a further aspect, the insulating layer includes an upper insulating layer, a lower insulating layer, a left insulating layer and a right insulating layer, the upper insulating layer and the lower insulating layer are coated on the upper surface and the lower surface of the core conductive module respectively, the left insulating layer and the right insulating layer are coated on the left side and the right side of the core conductive module respectively.

In yet another aspect, the upper insulating layer and the lower insulating layer are an upper insulating film and a lower insulating film respectively, and the left insulating layer and the right insulating layer are left insulating glue and right insulating glue respectively.

In yet another aspect, the left conductive metal layer penetrates the left insulating layer partially, and the right conductive metal layer penetrates the right insulating layer partially, so as to be connected with the upper metal foil and the lower metal foil of the conductive unit respectively.

In yet another aspect, the left conductive metal layer penetrates the upper insulating layer partially, and the right conductive metal layer penetrates the lower insulating layer partially, so as to be connected with the upper metal foil and the lower metal foil of the conductive unit respectively.

In a further aspect, the conductive polymer chip is manufactured by at least one crystalline polymer, conductive fillers and processing aids mixed through processing methods such as twin-screw extrusion and rolling.

In a further aspect, the upper metal foil, the lower metal foil, the left conductive metal layer and the right conductive metal layer are one or more selected from copper, iron, nickel, tin, silver and gold respectively, of course, they can also adopt other suitable metals; the insulating layer and the insulating material layer are one or more selected from polypropylene resin, bisphenol epoxy resin, epoxy phenolic resin, silicone resin, or a glass fiber enhanced mixture, respectively, of course, they can also adopt other suitable insulating materials.

In a further aspect, the thickness of the conductive polymer chip is 0.10~5 mm.

In a further aspect, the left conductive metal layer and the right conductive metal layer are U-shaped thin-wall metal layers.

In a further aspect, the laminated SMD-type thermistor further comprises an upper plating resistant film and a lower plating resistant film, the upper plating resistant film and the lower plating resistant film are coated on the upper surface and the lower surface of the conductive module respectively for separating the left conductive metal layer and the right conductive metal layer.

In yet another aspect, the upper plating resistant film and the lower plating resistant film are one or more selected from polypropylene resin, epoxy resin, silicone resin, of course, they can also adopt other suitable macromolecular polymer materials.

In a second aspect of the present invention, a manufacturing method of the above-mentioned laminated SMD-type thermistor is provided, and comprises the following steps:

(1) Manufacturing the conductive polymer chip, and laminating two metal foils, i.e. the upper metal foil and the lower metal foil, on the upper surface and the lower surface of the conductive polymer chip respectively, so as to form the conductive unit;

(2) Adopting the conductive unit as the core conductive module directly;

(3) Coating the insulating layer on the upper surface, the lower surface, the left side and the right side of the core conductive module, so as to form the conductive module;

(4) Grooving on the insulating layer through physical processing methods to expose two metal foils of the conductive unit partially;

(5) Coating the left conductive metal layer and the right conductive metal layer to the left part and the right part of the conductive module, and connecting them with two metal foils of the conductive unit respectively; or an upper plating resistant film and a lower plating resistant film are coated on the middle areas of the upper surface and the lower surface of the conductive module, then plating the assembly as a whole, so as to form the left conductive metal layer and the right conductive metal layer connected with two metal foils of the conductive unit respectively.

In a further aspect, in the step (1), the conductive polymer chip is manufactured by mixing at least one crystal polymer, conductive fillers and processing aids and passing them through a twin-screw extrusion and rolling machine.

In a further aspect, in the step (1), the thickness of the conductive polymer chip is 0.10~5 mm.

In a further aspect, the upper metal foil, the lower metal foil, the left conductive metal layer and the right conductive metal layer are one or more selected from copper, iron, nickel, tin, silver and gold respectively. Of course, they can also adopt other suitable metals; the insulating layer and the insulating material layer are one or more selected from polypropylene resin, bisphenol epoxy resin, epoxy phenolic resin, silicone resin, or a glass fiber enhanced mixture, respectively, of course, they can also adopt other suitable insulating materials; the upper plating resistant film and the lower plating resistant film are one or more selected from polypropylene resin, epoxy resin, silicone resin, of course, they can also adopt other suitable macromolecular polymer materials.

In a further aspect, in the step (3), the insulating layer includes an upper insulating layer, a lower insulating layer, a left insulating layer and a right insulating layer, the upper insulating layer and the lower insulating layer are coated on the upper surface and the lower surface of the core conductive module respectively, the left insulating layer and the right insulating layer are coated on the left side and the right side of the core conductive module respectively.

In yet another aspect, insulating glue is applied on the left side and the right side of the core conductive module respectively, and solidified, so as to form the left insulating layer and the right insulating layer.

In a further aspect, in the step (4), the physical processing methods include but not limited to the laser processing method.

In a further aspect, after the step (2) and before the step (3), the manufacturing method of the above-mentioned laminated SMD-type thermistor further comprises the following step:

(21) Cutting the core conductive module into an appropriate shape.

In a third aspect of the present invention, a laminated SMD-type thermistor is provided, and comprises a conductive module, a left conductive metal layer and a right conductive metal layer, the conductive module includes a core conductive module and an insulating layer which are coated on the upper surface, the lower surface, the left side and the right side of the core conductive module, the core conductive module includes at least two conductive units piled up in sequence and separated by an insulating material layer, the conductive unit includes an upper metal foil, a conductive polymer chip with PTC property and a lower metal foil which are laminated in sequence from top to bottom, the left conductive metal layer and the right conductive metal layer are coated on the left part and the right part of the conductive module respectively, and penetrate the insulating layer partially, so as to be connected with the upper metal foil/the lower metal foil and the lower metal foil/the upper metal foil of the conductive unit respectively.

In a further aspect, the insulating layer includes an upper insulating layer, a lower insulating layer, a left insulating layer and a right insulating layer, the upper insulating layer and the lower insulating layer are coated on the upper surface and the lower surface of the core conductive module respectively, the left insulating layer and the right insulating layer are coated on the left side and the right side of the core conductive module respectively.

In yet another aspect, the upper insulating layer and the lower insulating layer are an upper insulating film and a lower insulating film respectively, and the left insulating layer and the right insulating layer are left insulating glue land right insulating glue respectively.

In yet another aspect, the number of the conductive units is 2. Apparently, the number of the conductive units can be bigger than 2, and the specific number can be determined according to the actual requirements.

In yet another aspect, the left conductive metal layer penetrates the left insulating layer partially, so as to be connected with the upper metal foil of one conductive unit and the lower metal foil of another conductive unit, and the right conductive metal layer penetrates the right insulating layer partially, so as to be connected with the lower metal foil of one conductive unit and the upper metal foil of another conductive unit.

In yet another aspect, the left conductive metal layer penetrates the upper insulating layer and the lower insulating layer partially, so as to be connected with the upper metal foil of one conductive unit and the lower metal foil of another conductive unit, and the right conductive metal layer penetrates the right insulating layer partially, so as to be connected with the lower metal foil of one conductive unit and the upper metal foil of another conductive unit.

In a further aspect, the conductive polymer chip is manufactured by at least one crystalline polymer, conductive fillers and processing aids mixed through processing methods such as twin-screw extrusion and rolling.

In a further aspect, the upper metal foil, the lower metal foil, the left conductive metal layer and the right conductive metal layer are one or more selected from copper, iron, nickel, tin, silver and gold respectively, of course, they can also adopt other suitable metals; the insulating layer and the insulating material layer are one or more selected from polypropylene resin, bisphenol epoxy resin, epoxy phenolic resin, silicone resin, or a glass fiber enhanced mixture, respectively, of course, they can also adopt other suitable insulating materials.

In a further aspect, the thickness of the conductive polymer chip is 0.10~5 mm.

In a further aspect, the left conductive metal layer and the right conductive metal layer are U-shaped thin-wall metal layers.

In a further aspect, the laminated SMD-type thermistor further comprises an upper plating resistant film and a lower plating resistant film, the upper plating resistant film and the lower plating resistant film are coated on the upper surface and the lower surface of the conductive module respectively for separating the left conductive metal layer and the right conductive metal layer.

In yet another aspect, the upper plating resistant film and the lower plating resistant film are one or more selected from polypropylene resin, epoxy resin, silicone resin, of course, they can also adopt other suitable macromolecular polymer materials.

In a fourth aspect of the present invention, a manufacturing method of the above-mentioned laminated SMD-type thermistor is provided, and comprises the following steps:

(1) Manufacturing the conductive polymer chip, and laminating two metal foils, i.e. the upper metal foil and the lower metal foil, on the upper surface and the lower surface of the conductive polymer chip respectively, so as to form the conductive unit;

(2) Piling up two or more conductive units in sequence and separating two conductive units with the insulating material layer, so as to form the core conductive module;

(3) Coating the insulating layer on the upper surface, the lower surface, the left side and the right side of the core conductive module, so as to form the conductive module;

(4) Grooving on the insulating layer through physical processing methods to expose two metal foils of the conductive unit partially;

(5) Coating the left conductive metal layer and the right conductive metal layer on the left part and the right part of the conductive module, and connecting them with two metal foils of the conductive unit respectively; or an upper plating resistant film and a lower plating resistant film are coated on the middle areas of the upper surface and the lower surface of the conductive module, then plating the assembly as a whole, so as to the left conductive metal layer and the right conductive metal layer connected with two metal foils of the conductive unit respectively.

In a further aspect, in the step (1), the conductive polymer chip is manufactured by mixing at least one crystalline polymer, conductive fillers and processing aids and passing them through a twin-screw extrusion and rolling machine.

In a further aspect, in the step (1), the thickness of the conductive polymer chip is 0.10~5 mm In a further aspect, the upper metal foil, the lower metal foil, the left conductive metal layer and the right conductive metal layer are one or more selected from copper, iron, nickel, tin, silver and gold respectively, of course, they can also adopt other suitable metals; the insulating layer and the insulating material layer are one or more selected from polypropylene resin, bisphenol epoxy resin, epoxy phenolic resin, silicone resin, or a glass fiber enhanced mixture, respectively, of course, they can also adopt other suitable insulating materials; the upper plating resistant film and the lower plating resistant film are one or more selected from polypropylene resin, epoxy resin, silicone resin, of course, they can also adopt other suitable macromolecular polymer materials.

In a further aspect, in the step (3), the insulating layer includes an upper insulating layer, a lower insulating layer, a left insulating layer and a right insulating layer, the upper insulating layer and the lower insulating layer are coated on the upper surface and the lower surface of the core conductive module respectively, the left insulating layer and the right insulating layer are coated on the left side and the right side of the core conductive module respectively.

In yet another aspect, insulating glue is applied on the left side and the right side of the core conductive module respectively, and solidified, so as to form the left insulating layer and the right insulating layer.

In a further aspect, in the step (4), the physical processing methods include but not limited to the laser processing method.

In a further aspect, after the step (2) and before the step (3), the manufacturing method of the above-mentioned laminated SMD-type thermistor further comprises the following step:

(21) Cutting the core conductive module into an appropriate shape.

In a fifth aspect of the present invention, a laminated SMD-type thermistor is provided, and comprises a conductive module, a left conductive metal layer and a right conductive metal layer insulated with each other, the conductive module includes a core conductive module and an insulating layer which is coated on the upper surface and the lower surface of the core conductive module, the core conductive module includes at least two conductive polymer chips with PTC property piled up in sequence, adjacent conductive polymer chips with PTC property are separated by a central metal layer, the top surface of the upmost conductive polymer chip with PTC property is coated with an upper metal layer, the bottom surface of the lowest conductive polymer chip with PTC property is coated with a lower metal layer, the left conductive metal layer and the right conductive metal layer are coated on the left part and the right part of the conductive module respectively, and the upper metal layer, the central metal layer and the lower metal layer are connected conductively and respectively in sequence with the left conductive metal layer and the right conductive metal layer according to the parity interval manner.

In a further aspect, the insulating layer includes an upper insulating layer and a lower insulating layer, the upper insulating layer and the lower insulating layer are coated on the upper surface and the lower surface of the core conductive module respectively.

In yet another aspect, the insulating layer further includes a left insulating layer and a right insulating layer, the left insulating layer and the right insulating layer are coated on the left side and the right side of the core conductive module respectively, the left conductive metal layer is coated on the outside of the left insulating layer, and the left conductive metal layer penetrates the left insulating layer partially, so as to be connected conductively with the corresponding parts of the upper metal layer, the central metal layer and the lower metal layer, the right conductive metal layer is coated on the outside of the right insulating layer, and the right conductive metal layer penetrates the right insulating layer partially, so as to be connected conductively with the corresponding parts of the upper metal layer, the central metal layer and the lower metal layer.

In yet another aspect, the number of the conductive polymer chips with PTC property can be an even number.

In yet another aspect, the insulating layer further includes a left insulating layer and a right insulating layer, the left insulating layer and the right insulating layer are coated on the left side and the right side of the core conductive module respectively, the left conductive metal layer is coated on the outside of the left insulating layer, and the left conductive metal layer penetrates the left insulating layer partially, so as to be connected conductively with the corresponding part of the central metal layer, the right conductive metal layer is coated on the outside of the right insulating layer, and the right conductive metal layer penetrates the right insulating layer partially, so as to be connected conductively with the corresponding part of the central metal layer, the left conductive metal layer penetrates the upper insulating layer and the lower insulating layer partially so as to be connected conductively with the upper metal layer and the lower metal layer respectively.

In yet another aspect, the number of the conductive polymer chips with PTC property can be an odd number.

In a further aspect, the insulating layer further includes a left insulating layer and a right insulating layer, the left insulating layer and the right insulating layer are coated on the left side and the right side of the core conductive module respectively, the left conductive metal layer is coated on the outside of the left insulating layer, and the left conductive metal layer penetrates the left insulating layer partially, so as to be connected conductively with the corresponding part of the central metal layer, the right conductive metal layer is coated on the outside of the right insulating layer, and the right conductive metal layer penetrates the right insulating layer partially, so as to be connected conductively with the corresponding part of the central metal layer, the left conductive metal layer penetrates the upper insulating layer partially, so as to be connected conductively with the upper metal layer, the right conductive metal layer penetrates the lower insulating layer partially, so as to be connected conductively with the lower metal layer.

In yet another aspect, the laminated SMD-type thermistor further comprises an upper plating resistant film and a lower plating resistant film, the upper plating resistant film and the lower plating resistant film are coated on the upper surface and the lower surface of the conductive module respectively for separating and insulating the left conductive metal layer and the right conductive metal layer.

In a further aspect, the central metal layer is a metal foil with double matt sides.

In yet another aspect, the upper metal layer and the lower metal layer are metal foils with single matt side, and the matt side of the metal foils with single matt side is coated on the corresponding surface of the conductive polymer chip with PTC property.

In a sixth aspect of the present invention, a manufacturing method of the above-mentioned laminated SMD-type thermistor is provided, and comprises the following steps:

(1) Manufacturing the conductive polymer chip, piling up two or more conductive polymer chips with PTC property in sequence, separating two adjacent conductive polymer chips with PTC property with the central metal layer, the upper metal layer is coated on the top surface of the upmost conductive polymer chip with PTC property, the lower metal layer is coated on the bottom surface of the lowest conductive polymer chip with PTC property, so as to form the core conductive module;

(2) Coating the insulating layer on the upper surface, the lower surface, the left side and the right side of the core conductive module, so as to form the conductive module;

(3) Grooving on the insulating layer through physical processing methods to expose the central metal layer, the upper metal layer and the lower metal layer partially;

(4) Coating the left conductive metal layer and the right conductive metal layer on the left part and the right part of the conductive module, and connecting conductively and respectively the upper metal layer, the central metal layer and the lower metal layer in sequence with the left conductive metal layer and the right conductive metal layer according to the parity interval manner; or, an upper plating resistant film and a lower plating resistant film are coated on the middle areas of the upper surface and the lower surface of the conductive module, then plating the assembly as a whole, so as to form the left conductive metal layer and the right conductive metal layer, and connect conductively and respectively the upper metal layer, the central metal layer and the lower metal layer in sequence with the left conductive metal layer and the right conductive metal layer according to the parity interval manner.

In a further aspect, in the step (1), the conductive polymer chip is manufactured by at least one crystalline polymer, conductive fillers and processing aids mixed through twin-screw extrusion and rolling.

In a further aspect, in the step (2), the insulating layer includes an upper insulating layer, a lower insulating layer, a left insulating layer and a right insulating layer, the upper insulating layer and the lower insulating layer are coated on the upper surface and the lower surface of the core conductive module respectively, the left insulating layer and the right insulating layer are coated on the left side and the right side of the core conductive module respectively.

In yet another aspect, insulating glue is applied on the left side and the right side of the core conductive module respectively, so as to form the left insulating layer and the right insulating layer.

In a further aspect, in the step (3), the physical processing methods include but not limited to the laser processing method.

In a further aspect, after the step (1) and before the step (2), the manufacturing method of the above-mentioned laminated SMD-type thermistor further comprises the following step:

(11) Cutting the core conductive module into an appropriate shape.

With the laminated SMD-type thermistor and manufacturing method thereof of the present invention, the laminated SMD-type thermistor has a novel structure, a superior performance, a high rate of qualified products and a unique manufacturing process, with the manufacturing method, the etching process is not needed to be performed on the surfaces of the metal foils, only the physical processing (e.g. laser vaporization) process is performed on two layers of insulating glue (or two insulating films, or one layer of insulating glue and one insulating film) of the conductive module formed having the insulating layer on the upper, lower, left and right surfaces, to expose the metal foils partially and connect them with two plated metal layers coated outside respectively. So on the whole, it is unnecessary for its manufacturing method to perform secondary processing on the surfaces of the metal foils, only a secondary treatment is needed to be performed on the surfaces of the surrounding insulating film/insulating glue, to form a very small physical processing grooving area. Compared with the traditional process, the above-mentioned laminated SMD-type thermistor and manufacturing method thereof of the present invention have the following advantages:

(1) The organic particulate matters produced by grooving through physical processing (such as laser processing, etc.) can be recycled easily through sealed pipes, so it is environmentally friendly, and there is no shortcoming similar to that of the etching fluid polluting the environmental seriously;

(2) Compared with the cost of chemical etching (for single layer PTC element, the cost is about 0.08 yuan/piece, for multi-layer PTC element, the cost doubles), the grooving cost (for single layer PTC element, the cost is about 0.01 yuan/piece, for multi-layer PTC element, the cost increases less) through the physical processing (e.g., laser processing, etc.) is lower, thus saving a lot of production costs.

(3) it is uneasy to produce abnormal defects similar to those such as shift, dislocation and so on that are produced easily for the etching pattern, thus the grooving process through physical processing (e.g., laser processing, etc.) is more stable;

(4) the accuracy of grooving through physical processing is high, for example, the straight line accuracy of physical processing and so on can be up to 0.05 mm, the width of laser processing also can reach 0.05 mm, the yield rate is higher than that of the traditional process;

(5) The materials required in forming the element are relatively few, making the total cost of the raw materials less than that of the traditional structure;

(6) For the materials are relatively few, the manufacturing processes required are relatively few, making the total rate of finished products relatively high;

(7) For the roughness of the surfaces of the metal foil with double matt sides is relatively large, the adhesive force for combining the PTC chip is relatively big, making the combination of the materials more compact, and for the materials are relatively few, the rate to produce abnormal phenomena such as shift, dislocation and so on during carrying out processes such as hot pressing and so on is relatively small, to make the structure more stable and reliable.

DETAILED DESCRIPTION OF THE PREFERRED EMBODIMENT

In order to understand the technical content of the present invention clearly, the present invention is further exemplified by reference to the following embodiments.

Embodiment 1

The laminated SMD-type thermistor with PTC property and manufacturing method thereof of Embodiment 1 of the present invention are exemplified by reference to FIG. 1A~FIG. 1I.

Figure 1A:
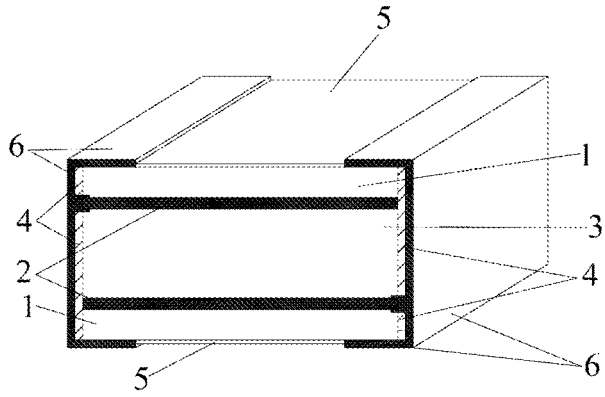
FIG. 1A is a schematic three-dimensional view of a first embodiment of the laminated SMD-type thermistor of the present invention.

FIG. 1A is the structure view of the laminated SMD-type thermistor with PTC property of Embodiment 1 of the present invention.

In FIG. 1A, the conductive polymer chip 3 with PTC property is a macromolecular polymer sheet formed by a mixture including one or more crystalline polymers, conductive fillers, processing aids and so on, the metal foils 2 are coated evenly on the upper and lower surfaces of the above-mentioned conductive polymer chip 3 with PTC property; the insulating films 1 are coated tightly and evenly on the surfaces of the above-mentioned two metal foils 2; the insulating glue 4 is applied on the left and right sides of the above-mentioned conductive polymer chip 3 with PTC property, the insulating glue 4 on the two sides is divided into four parts totally; the plating resistant films 5 are coated tightly and evenly on the middle areas of the above-mentioned insulating films 1 on the upper and lower surfaces, and the plating resistant films 5 on the upper and lower surfaces are divided into two parts totally; one physical processing grooving area is formed in the gap of the insulating glue 4 at each of the left and right sides, the plating conductive metal layers 6 at two ends are attached well to the surfaces of the insulating glue 4, the insulating films 1 and the metal foils 2 in the physical processing grooving areas, making the plating conductive metal layers 6 at two ends the left end and the right end and the above-mentioned two metal foils 2 maintain a good electrical connection.

The manufacturing method of the laminated SMD-type thermistor with PTC property of Embodiment 1 of the present invention is exemplified by reference to FIG. 1A~FIG. 1I.

Figure 1B:
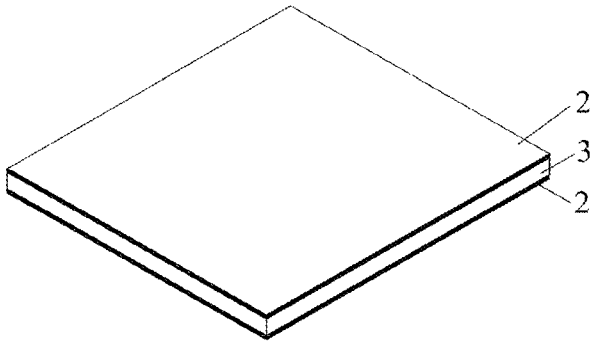
FIG. 1B~FIG. 1I are schematic views of the manufacturing process of the first embodiment shown in FIG. 1A.
Figure 1C:
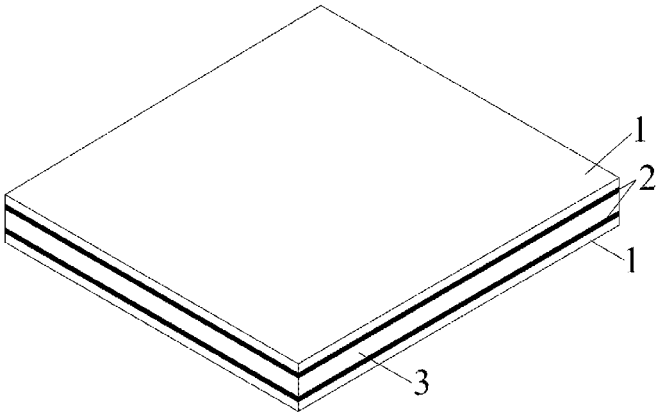
Figure 1D:
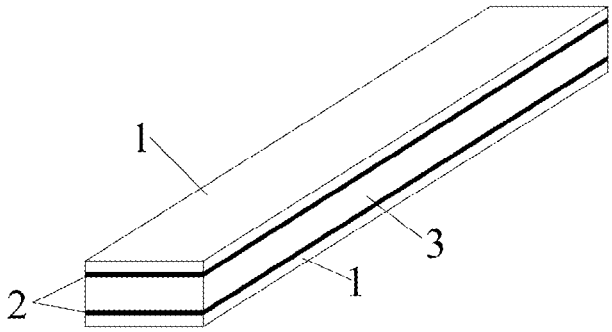
Figure 1E:
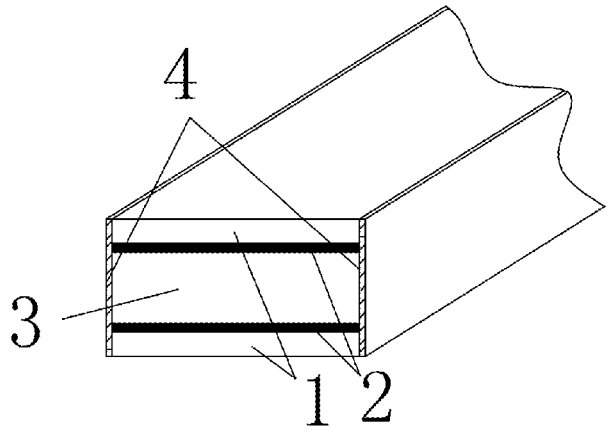
Figure 1F:
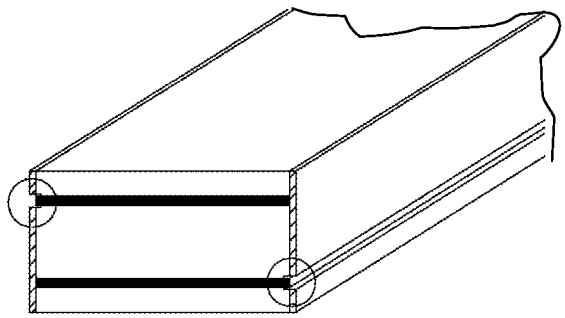
Figure 1G:
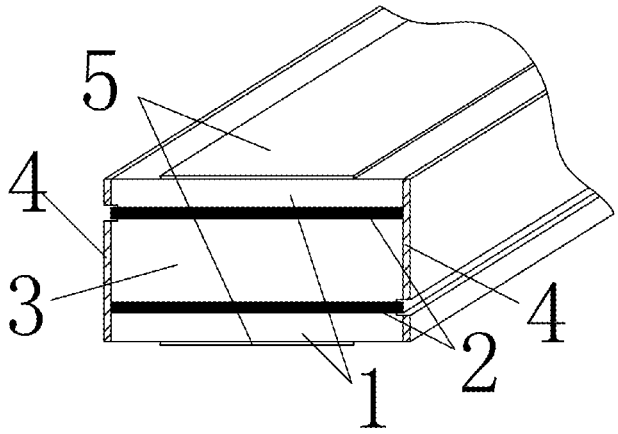
Figure 1H:
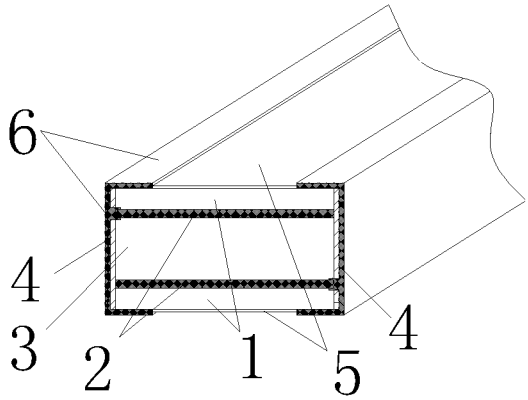
Figure 1I:
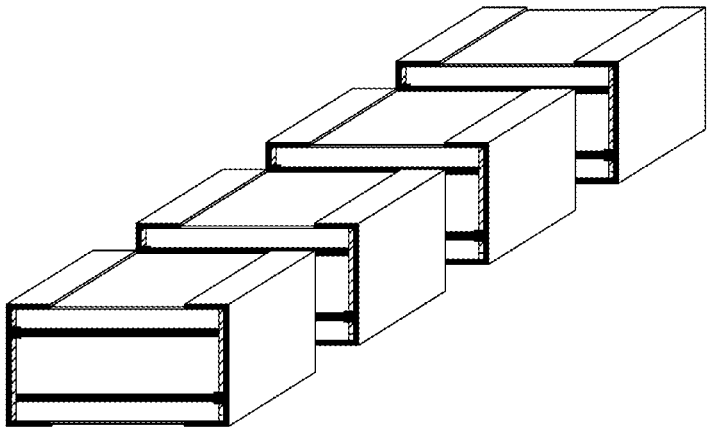

Firstly, the raw materials such as one or more crystalline polymers, conductive fillers, processing aids and so on were mixed and passed through a twin-screw extrusion and rolling mill to manufacture the core conductive module with the total thickness of 0.10~5 mm, as shown in FIG. 1B, the feature of the core conductive module obtained by the above processes is that the metal foils 2 are laminated tightly on the upper and lower surfaces of the conductive polymer chip 3;

Then, two insulating films 1 are coated on the upper and lower surfaces of the above-mentioned core conductive module respectively, to form the sheet shown in FIG. 1C;

Then it is cut into bar-shaped sheets with prescribed width, as shown in FIG. 1D; or the cutting is made before coating the insulating films 1; and if the sheet shown in FIG. 1C has been the right size, it does not need to be cut;

Then, two layers of insulating glue 4 are applied on the left and right sides of one of the above-mentioned bar-shaped sheets respectively and solidified, to make four sides, the left, right, upper and lower sides of the core conductive module be coated with the insulating layer, so as to form the conductive module precursor, as shown in FIG. 1E;

Then on the left side and the right side of the above-mentioned conductive module precursor, the surfaces of the outside insulating coating layers are grooved through physical processing methods (such as laser processing, etc.), to expose the inner metal foils partially, to form the conductive module with physical processing grooving areas (as shown in the circles of FIG. 1F), as shown in FIG. 1F;

Subsequently, two plating resistant films 5 are applied on the middle areas of the upper and lower surfaces of the above-mentioned conductive module, to form the sheet, as shown in FIG. 1G;

Then it is plated as a whole, to form the bar-shaped sheet having the conductive metal layers 6, as shown in FIG. 1H;

Finally, the bar-shaped thin sheet as shown in FIG. 1H is cut into single SMD-type elements with prescribed size, as shown in FIG. 1I, if the bar-shaped thin sheet as shown in FIG. 1H has been the size of the single SMD-type element, it does not need to be cut, please refer to FIG. 1A for its specific structure.

In the above-mentioned processes, the sequence of the process of applying the plating resistant films 5 and the process of grooving through physical processing can be changed, which does not affect the manufacturing of the SMD-type thermistor with PTC property.

Here, only the manufacturing processes are illuminated according to the specific structure of the product, specific parameters of the various processes are not described in details, however the processes of radiation cross-linking and heat treatment can be added into the above-mentioned various processes, according to the requirements of electrical properties (such as resistance-temperature property, current property, voltage-current property) of specific elements. It is same to the following various embodiments, and would not be repeated.

Embodiment 2

The laminated SMD-type thermistor with PTC property and manufacturing method thereof of Embodiment 2 of the present invention are exemplified by reference to FIG. 2A~FIG. 2D.

Figure 2A:
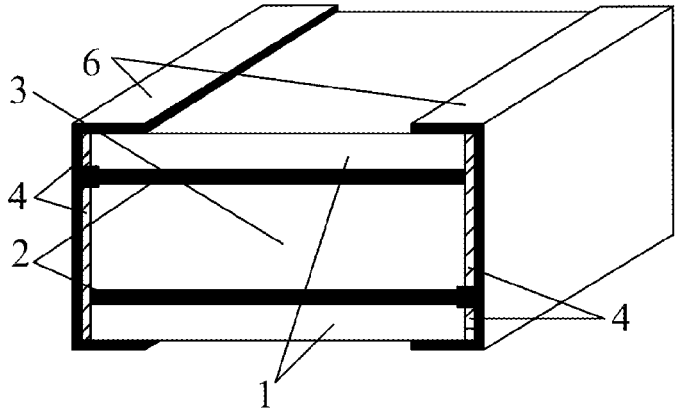
FIG. 2A is a schematic three-dimensional view of a second embodiment of the laminated SMD-type thermistor of the present invention.

FIG. 2A is the structure view of the laminated SMD-type thermistor with PTC property of Embodiment 2 of the present invention.

In FIG. 2A, the conductive polymer chip 3 with PTC property is a macromolecular polymer sheet formed by a mixture including one or more crystalline polymers, conductive fillers, processing aids and so on, the metal foils 2 are coated evenly on the upper and lower surfaces of the above-mentioned conductive polymer chip 3 with PTC property; the insulating films 1 are coated tightly and evenly on the surfaces of the above-mentioned two metal foils 2; the insulating glue 4 is applied on the left and right sides of the above-mentioned conductive polymer chip 3 with PTC property, the insulating glue 4 on the two sides is divided into four parts totally; one physical processing grooving area is formed in the gap of the insulating glue 4 at each of the left and right sides, the conductive metal layers 6 at the left and right ends and parts of the upper and right surfaces are attached well to the surfaces of the insulating glue 4, the insulating films 1 and the metal foils 2 in the physical processing grooving areas, making the conductive metal layers 6 and the above-mentioned two metal foils 2 maintain a good electrical connection.

The manufacturing method of the laminated SMD-type thermistor with PTC property of Embodiment 2 of the present invention is exemplified by reference to FIG. 2A~FIG. 2D.

Figure 2B:
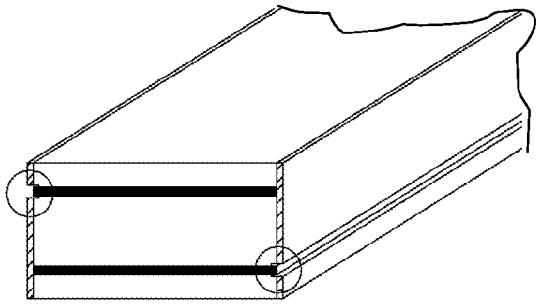
FIG. 2B~FIG. 2D are schematic views of the manufacturing process of the second embodiment shown in FIG. 2A.
Figure 2C:
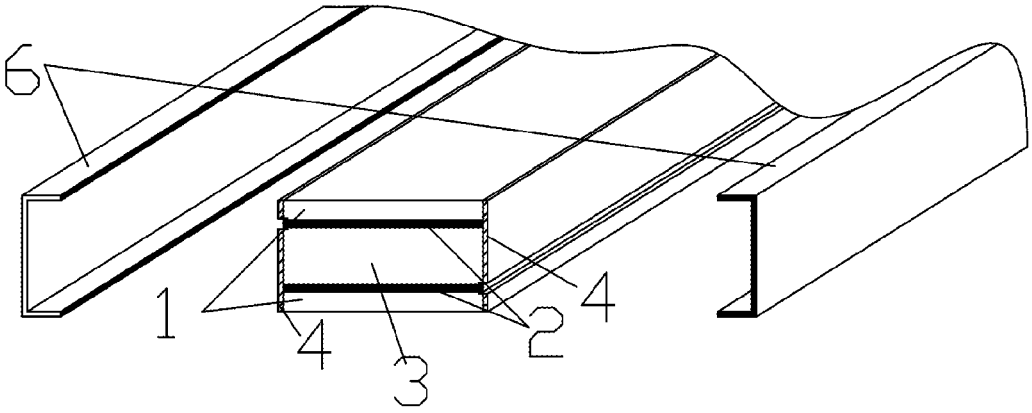
Figure 2D:
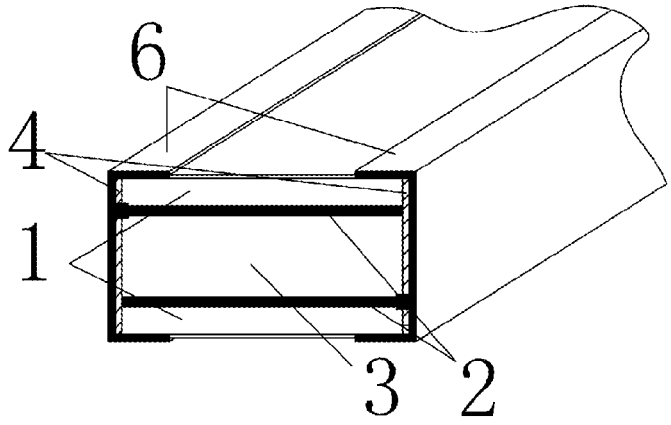

The same processes corresponding to FIG. 1B~F of Embodiment 1 are used, to form the conductive module with physical processing grooving areas (as shown in the circles of FIG. 2B), as shown in FIG. 2B;

Subsequently, after two sides of the above-mentioned conducive module are sheathed with the conductive metal layers 6, i.e. U-shaped thin-wall slots (please refer to FIG. 2C), the U-shaped thin-wall slots are connected with the PTC metal foils by methods such as welding, to form the bar-shaped thin sheet having the conductive metal layers 6, as shown in FIG. 2D;

Finally, the above-mentioned bar-shaped thin sheet is cut into single SMD-type elements with prescribed size, as shown in FIG. 2A, similarly, if the bar-shaped thin sheet as shown in FIG. 2D has been the size of the single SMD-type element, it does not need to be cut.

Embodiment 3

The laminated SMD-type thermistor with PTC property and manufacturing method thereof of Embodiment 3 of the present invention are exemplified by reference to FIG. 3A~FIG. 3E.

Figure 3A:
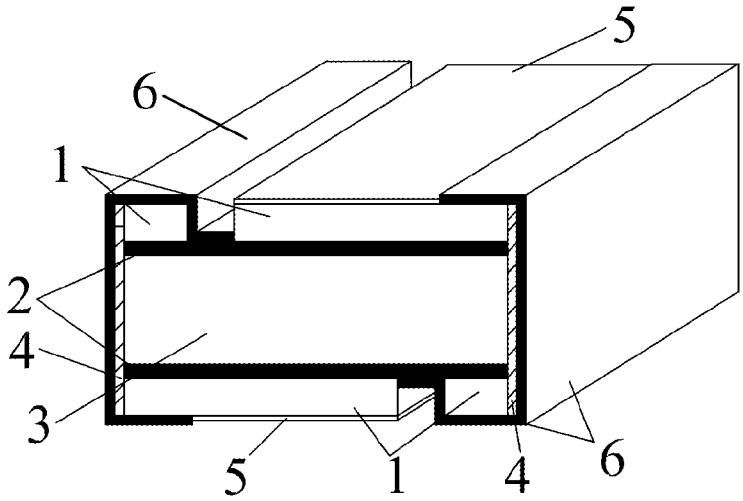
FIG. 3A is a schematic three-dimensional view of a third embodiment of the laminated SMD-type thermistor of the present invention.

FIG. 3A is the structure view of the laminated SMD-type thermistor with PTC property of Embodiment 3 of the present invention.

In FIG. 3A, the conductive polymer chip 3 with PTC property is a macromolecular polymer sheet formed by a mixture including one or more crystalline polymers, conductive fillers, processing aids and so on, the metal foils 2 are coated evenly on the upper and lower surfaces of the above-mentioned conductive polymer chip 3 with PTC property; the insulating films 1 are coated tightly and evenly on the surfaces of the above-mentioned two metal foils 2, the insulating films 1 on the two metal foils 2 are divided into four parts totally; the insulating glue 4 is applied on the left and right sides of the above-mentioned conductive polymer chip 3 with PTC property; the plating resistant films 5 are coated tightly and evenly on the middle areas of the upper and lower surfaces of the above-mentioned insulating films 1, and the plating resistant films 5 on the upper and lower surfaces are divided into two parts totally; one physical processing grooving area with groove is formed in the gap of the insulating film 1 at each of the upper and lower surfaces, the plating conductive metal layers 6 are attached well to the surfaces of the insulating glue 4, the insulating films 1 and the metal foils 2 in the physical processing grooving areas with groove at the upper and lower insulating films 1, making the left and right conductive metal layers 6 and the above-mentioned two metal foils 2 maintain a good electrical connection.

The manufacturing method of the laminated SMD-type thermistor with PTC property of Embodiment 3 of the present invention is exemplified by reference to FIG. 3A~FIG. 3E.

Figure 3B:
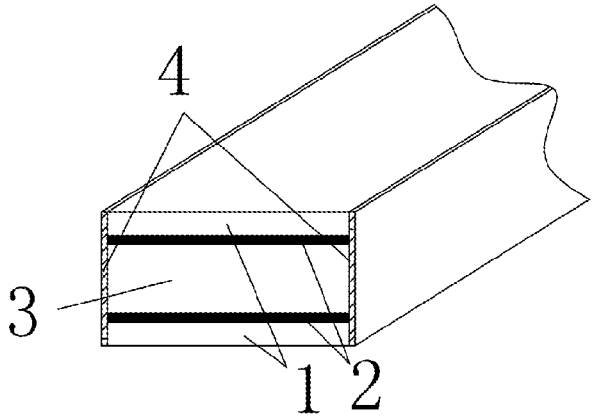
FIG. 3B~FIG. 3E are schematic views of the manufacturing process of the third embodiment shown in FIG. 3A.
Figure 3C:
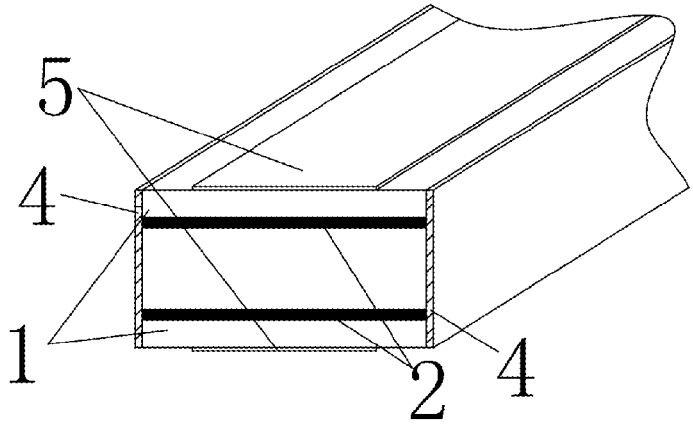
Figure 3D:
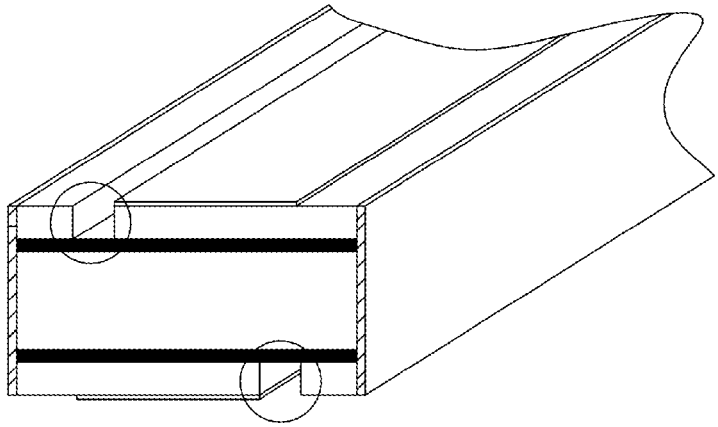
Figure 3E:
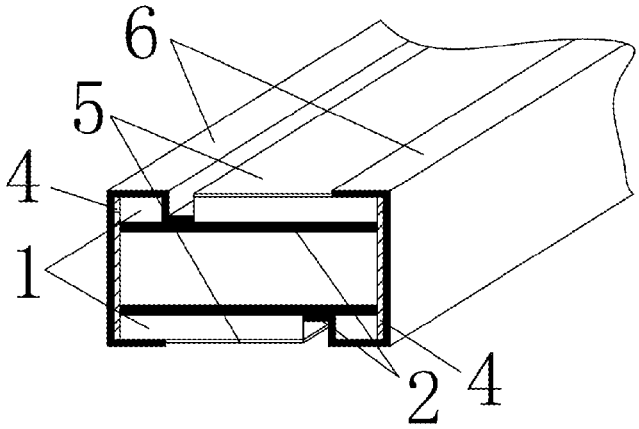

The same processes corresponding to FIG. 1B~E of Embodiment 1 are used, to form the first conductive module precursor, as shown in FIG. 3B;

Then, two plating resistant films 5 are applied on the middle areas of the upper and lower surfaces of the above-mentioned conductive module precursor, to form the second conductive module precursor, as shown in FIG. 3C, Then on the insulating films 1 of the upper and lower surfaces of the above-mentioned second conductive module precursor, the surfaces of the outside insulating coating layers are grooved through physical processing methods (such as laser processing, etc.), to expose the inner metal foils partially, so as to form the conductive module with physical processing grooving areas with groove (as shown in the circles of FIG. 3D), as shown in FIG. 3D;

Then the above-mentioned conductive module is plated as a whole, to from the bar-shaped thin sheet having the conductive metal layers 6, as shown in FIG. 3E;

Finally, the above-mentioned bar-shaped thin sheet is cut into single SMD-type elements with prescribed size, whose structural views are as shown in FIG. 3A, if the bar-shaped thin sheet as shown in FIG. 3E has been the size of the single SMD-type element, it does not need to be cut.

In the above-mentioned processes, the sequence of the process of cutting into bar-shaped thin sheets, the process of applying the insulating glue 4, the process of applying the plating resistant films 5 and the process of grooving through physical processing can be changed, which does not affect the manufacturing of the SMD-type thermistor with PTC property.

Similar to Embodiment 1 and Embodiment 2, here, after the process of grooving through physical processing as shown in FIG. 3D, the following processes can be conducted:

After two sides of the conductive module obtained by grooving through physical processing are sheathed with the U-shaped thin-wall slots, the U-shaped thin-wall slots are connected with the PTC metal foils by methods such as welding; finally, if necessary, the above-mentioned bar-shaped thin sheet formed is cut into single SMD-type elements with prescribed size. In this case, there are no above-mentioned upper and lower plating resistant films 5 as shown in FIG. 3A in the structure of the element obtained.

Embodiment 4

The laminated SMD-type thermistor with PTC property and manufacturing method thereof of Embodiment 4 of the present invention are exemplified by reference to FIG. 4A~FIG. 4G.

Figure 4A:
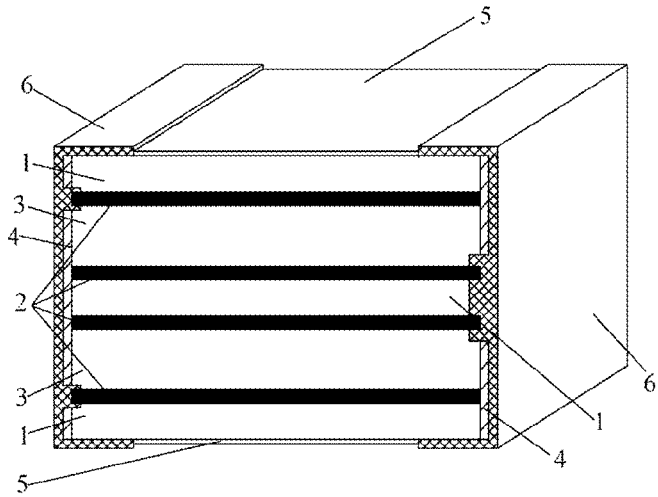
FIG. 4A is a schematic three-dimensional view of a fourth embodiment of the laminated SMD-type thermistor of the present invention.

FIG. 4A is the structure view of the laminated SMD-type thermistor with PTC property of Embodiment 4 of the present invention.

In FIG. 4A, the conductive polymer chip 3 with PTC property is a macromolecular polymer sheet formed by a mixture including one or more crystalline polymers, conductive fillers, processing aids and so on, as shown in the figure, two conductive polymer chips 3 with PTC property are formed totally; the metal foils 2 are coated evenly on the upper and lower surfaces of the above-mentioned conductive polymer chip 3 with PTC property, thus there are four metal foils 2 on two conductive polymer chips 3 with PTC property; the insulating films 1 are coated tightly and evenly on the surfaces of the above-mentioned four metal foils 2, for the four metal foils 2, there are three insulating films 1; the insulating glue 4 is applied on the left and right sides of the above-mentioned conductive polymer chip 3 with PTC property, the insulating films 1 and the metal foils 2, the insulating glue 4 on the two sides is divided into five parts totally; physical processing grooving areas with groove are formed at the joining of the insulating films 1, the metal foils 2 and the insulating glue 4 at the left and right sides, wherein there are two areas at the left side and one area at the right side; the plating resistant films 5 are pasted evenly on the middle areas of the above-mentioned insulating films 1 on the upper and lower surfaces, and the plating resistant films 5 on the upper and lower surfaces are divided into two parts totally; the conductive metal layers 6 at the left and right ends are attached well to the surfaces of the insulating glue 4, the insulating films 1 and the metal foils 2 in the physical processing grooving areas, making the conductive metal layers 6 at the left and right ends and the above-mentioned two metal foils 2 maintain a good electrical connection.

The manufacturing method of the laminated SMD-type thermistor with PTC property of Embodiment 4 of the present invention is exemplified by reference to FIG. 4A~FIG. 4G.

Figure 4B:
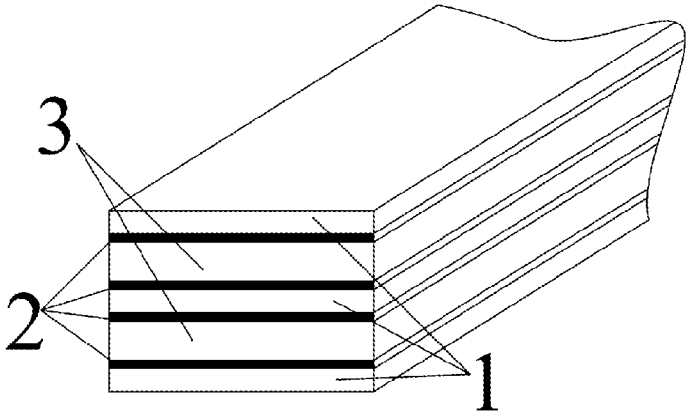
FIG. 4B~FIG. 4G are schematic views of the manufacturing process of the fourth embodiment shown in FIG. 4A.
Figure 4C:
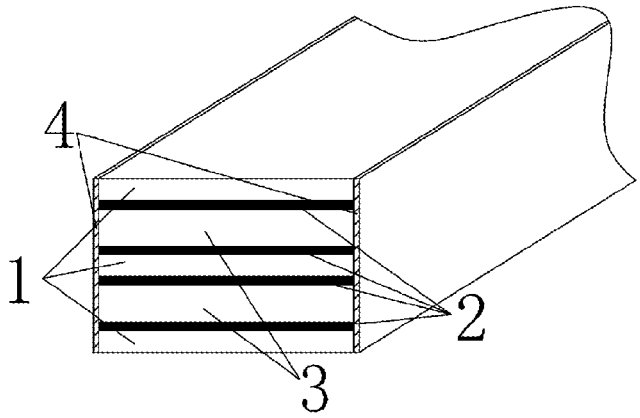
Figure 4D:
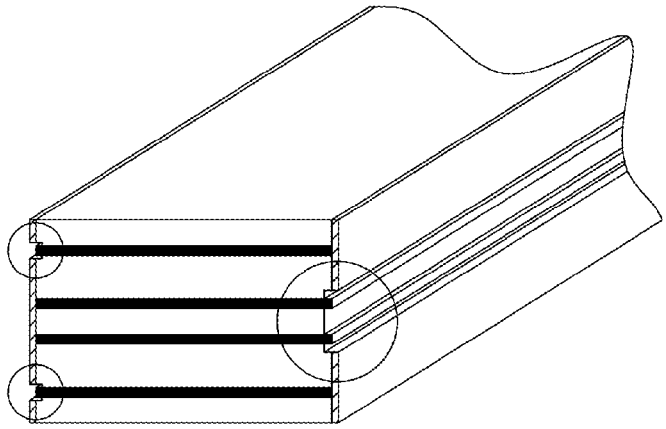
Figure 4E:
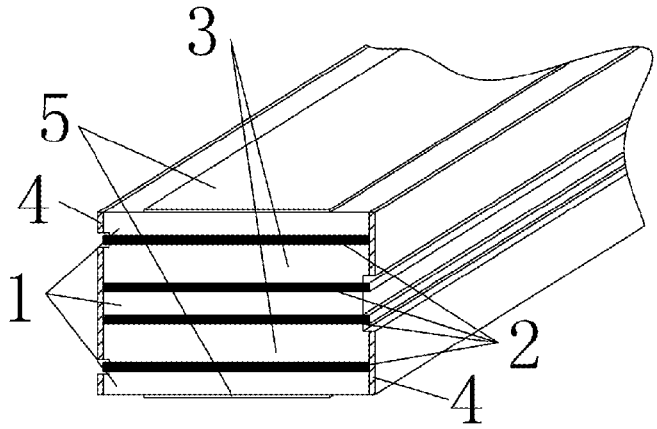
Figure 4F:
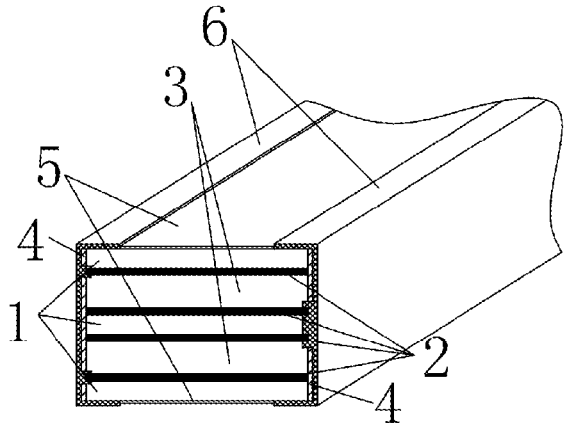
Figure 4G:
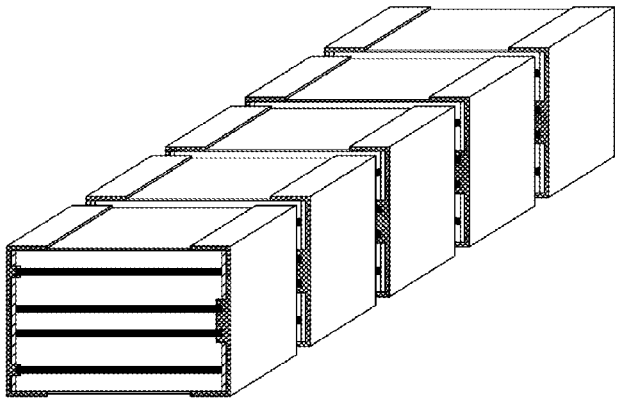

The raw materials such as one or more crystalline polymers, conductive fillers and processing aids and so on were mixed and passed through a twin-screw extrusion and rolling mill to manufacture the conductive polymer chip 3, the metal foils 2 are laminated tightly on the upper and lower surfaces of the conductive polymer chip 3, to form a single layer PTC thermistor thin sheet;

Later, two pieces of the above-mentioned single layer PTC thermistor thin sheets and three insulating films 1 are used to form a laminated two-layer PTC thermistor thin sheet, and its feature is that one insulating films 1 are laminated on each of the upper and lower surfaces of each of the above-mentioned single layer PTC thermistor thin sheet, then it is cut into bar-shaped laminated thin sheets with prescribed width, as shown in FIG. 4B; of course, if its size has been appropriate, it does not need to be cut;

Then, the insulating glue 4 is applied on the left and right sides of one of the above-mentioned bar-shaped laminated thin sheets respectively and solidified, to form four insulating coating layers on four sides of the thin sheet, so as to form the conductive module precursor, as shown in FIG. 4C;

Then on the left side and the right side of the above-mentioned conductive module precursor, the surfaces of the outside insulating coating layers are grooved through physical processing methods (such as laser processing, etc.), to expose the inner metal foils partially, to form the conductive module with three or more physical processing grooving areas (as shown in the circles of FIG. 4D, one at the left side, two at the right side), as shown in FIG. 4D;

Subsequently, two plating resistant films 5 are applied on the middle areas of the upper and lower surfaces of the above-mentioned conductive module, to form the laminated thin sheet, as shown in FIG. 4E;

Then it is plated as a whole, to from the laminated thin sheet having the conductive metal layers, as shown in FIG. 4F;

Finally, the laminated bar-shaped thin sheet as shown in FIG. 4F is cut into single SMD-type elements with prescribed size, as shown in FIG. 4G, similarly, if the laminated thin sheet as shown in FIG. 4F has been the size of the single SMD-type element, it does not need to be cut, please refer to FIG. 4A for its specific structure.

Similar to Embodiment 1 and Embodiment 2, here, after the process of grooving through physical processing as shown in FIG. 4D, the following processes can be conducted:

After two sides of the conductive module obtained by grooving through physical processing are sheathed with the U-shaped thin-wall slots, the U-shaped thin-wall slots are connected with the PTC metal foils by methods such as welding; finally, the above-mentioned bar-shaped thin sheet formed is cut into single SMD-type elements with prescribed size. In this case, there are no above-mentioned upper and lower plating resistant films 5 as shown in FIG. 4A in the structure of the element obtained.

In the above-mentioned process of grooving through physical processing such as laser vaporization, the physical processing grooving areas can be formed through other methods, as long as they do not affect the connecting property.

Embodiment 5

Figure 5:
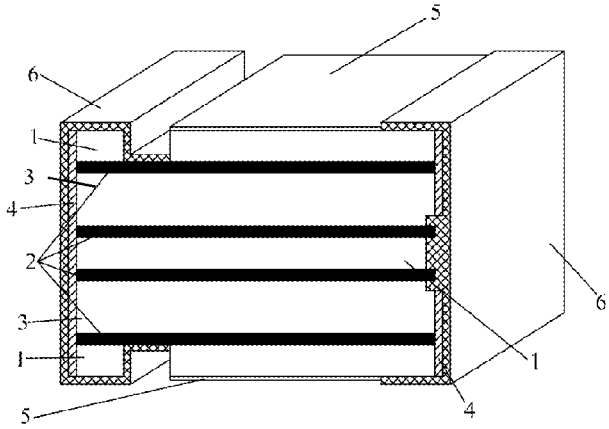
FIG. 5 is a schematic three-dimensional view of a fifth embodiment of the laminated SMD-type thermistor of the present invention.

For example, similar to the grooving method of grooving through physical processing as shown in Embodiment 3, an innovative structure of the physical processing grooving area formed through other methods is illustrated by FIG. 5. Obviously, it is not limited to the grooving method described in this case.

In FIG. 5, the conductive polymer chip 3 with PTC property is a macromolecular polymer sheet formed by a mixture including one or more crystalline polymers, conductive fillers, processing aids and so on, as shown in the figure, two conductive polymer chips 3 with PTC property are formed totally; the metal foils 2 are coated evenly on the upper and lower surfaces of the above-mentioned conductive polymer chip 3 with PTC property, thus there are four metal foils on two conductive polymer chips 3 with PTC property; the insulating films 1 are coated tightly and evenly on the surfaces of the above-mentioned four metal foils 2, for the four metal foils 2, there are three insulating films 1 which are divided into five parts; the insulating glue 4 is applied on the left and right sides of the above-mentioned conductive polymer chips 3 with PTC property, the insulating films 1 and the metal foils 2, the insulating glue 4 on the two sides is divided into three parts totally; physical processing grooving areas with groove are formed at the joining of the insulating films 1, the metal foils 2 and the insulating glue 4 at the left and right sides, wherein there is one area at each of the upper and lower surfaces and one area at the right side; the plating resistant films 5 are pasted evenly to the middle areas of the above-mentioned two insulating films 1, and the plating resistant films 5 are divided into two parts totally; the conductive metal layers 6 are attached well to the surfaces of the insulating glue 4, the insulating films 1 and the metal foils 2 in the physical processing grooving areas, making the conductive metal layers 6 at the left and right ends and the two metal foils 2 at the upper and lower surfaces of each of the above-mentioned conductive polymer chips 3 maintain a good electrical connection.

Embodiment 6

The laminated SMD-type thermistor with PTC property and manufacturing method thereof of Embodiment 6 of the present invention are exemplified by reference to FIG. 6A~FIG. 6F.

Figure 6A:
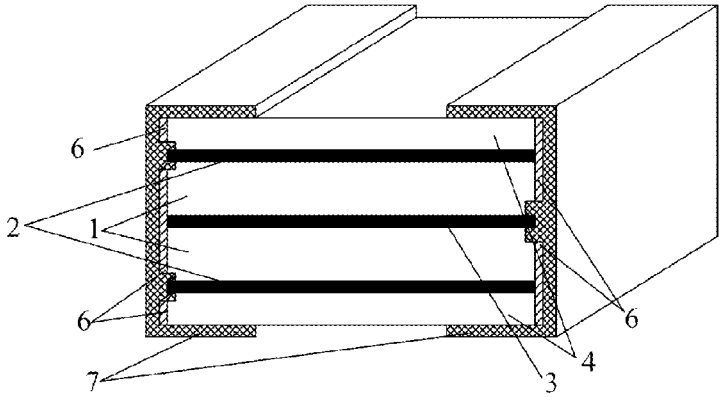
FIG. 6A is a schematic three-dimensional view of a sixth embodiment of the laminated SMD-type thermistor of the present invention.

FIG. 6A is the structure view of the laminated SMD-type thermistor with PTC property of Embodiment 6 of the present invention.

In FIG. 6A, the conductive polymer chip 1 with PTC property is a macromolecular polymer sheet formed by a mixture including one or more crystalline polymers, conductive fillers, processing aids and so on; one metal foil 3 with double matt sides is sandwiched between the above-mentioned upper and lower conductive polymer chips 1 with PTC property and coated evenly on the lower and upper surfaces of them respectively; two metal foils 2 with single matt side are coated evenly on the upper and lower surfaces of the above-mentioned two conductive polymer chips 1 with PTC property; the insulating films 4 are coated tightly and evenly on the surfaces of the above-mentioned two metal foils 2 with single matt side, the insulating films 4 on the two metal foils 2 with single matt side are divided into two parts totally; the insulating glue 6 is coated on the left and right sides of the above-mentioned assembly, there are three physical processing grooving areas with groove are existed in the gaps between the insulating films 4 on the upper and lower sides and the metal foils, wherein there are two areas at the left side and one area at the right side; the conductive metal layers 7 at the left and right ends and parts of the upper and lower surfaces are attached well to the surfaces of the insulating films 4, the insulating glue 6 and the metal foils 2 in the physical processing grooving areas with groove, making the conductive metal layers 7 and the above-mentioned metal foils maintain a good electrical connection.

The manufacturing method of the laminated SMD-type thermistor with PTC property of Embodiment 6 of the present invention is exemplified by reference to FIG. 6A~FIG. 6F.

Figure 6B:
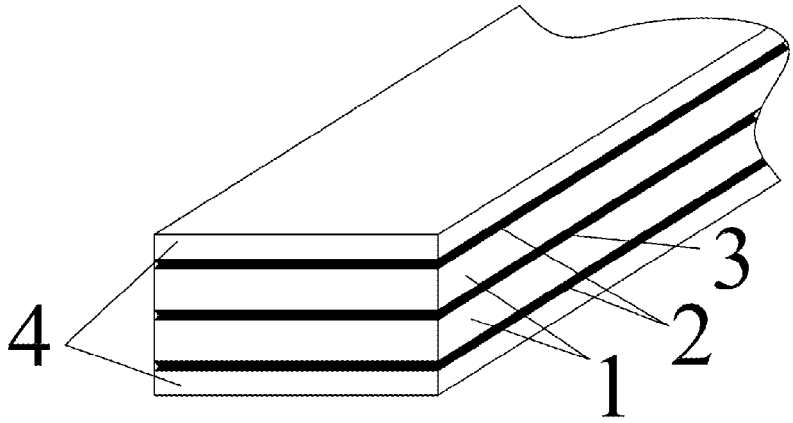
FIG. 6B~FIG. 6F are schematic views of the manufacturing process of the sixth embodiment shown in FIG. 6A.
Figure 6C:
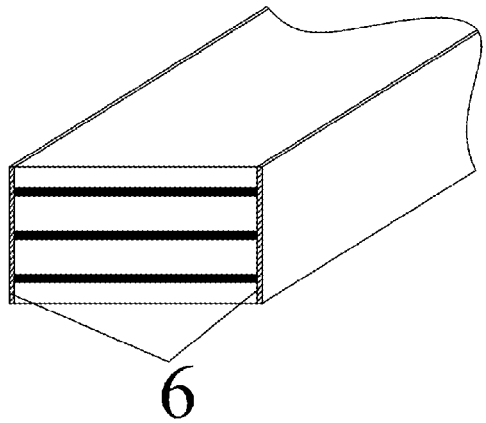
Figure 6D:
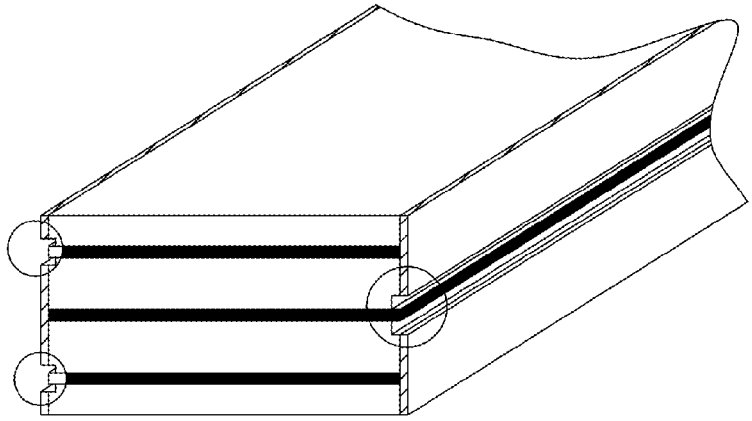
Figure 6E:
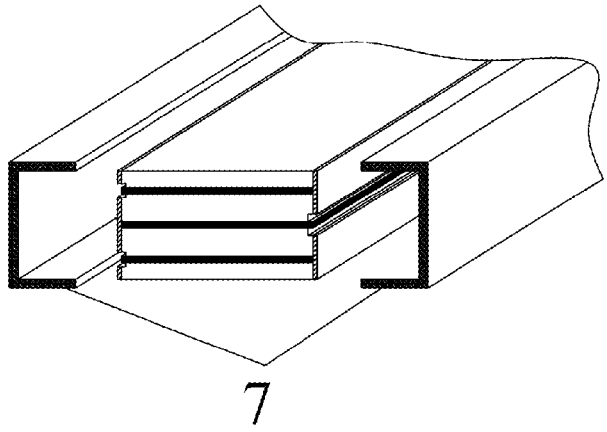
Figure 6F:
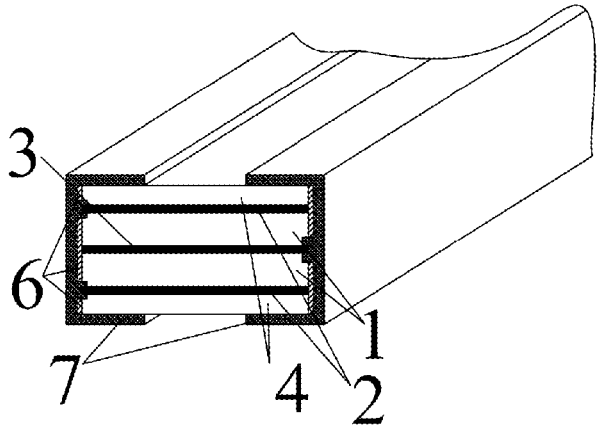
Figure 7A:
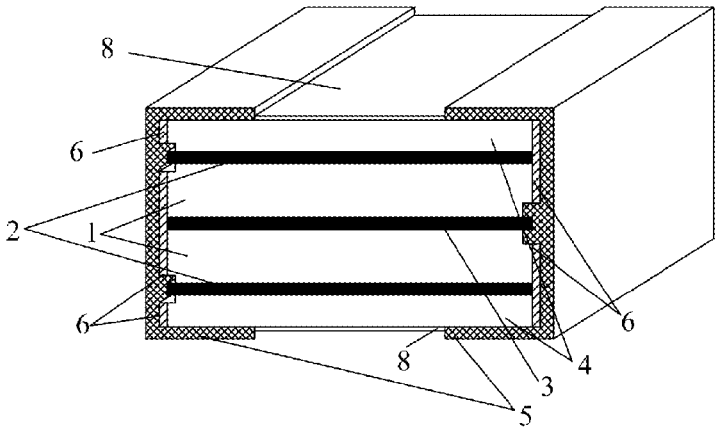
FIG. 7A is a schematic three-dimensional view of a seventh embodiment of the laminated SMD-type thermistor of the present invention.
Figure 7B:
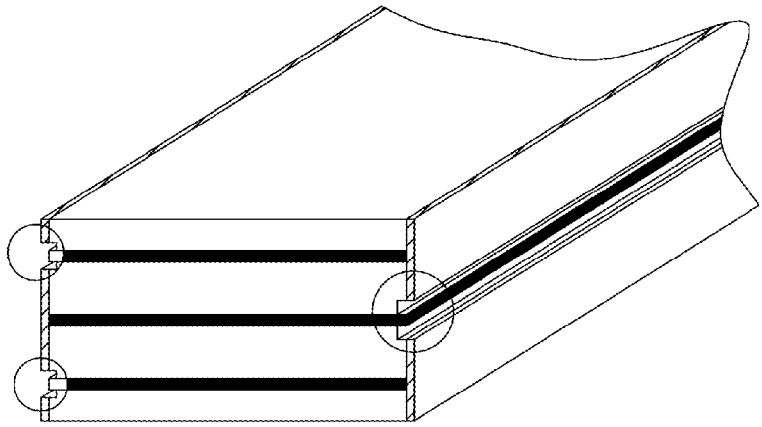
FIG. 7B~FIG. 7E are schematic views of the manufacturing process of the seventh embodiment shown in FIG. 7A.

(1) The raw materials such as one or more crystalline polymers, conductive fillers and processing aids and so on were mixed and manufactured to be a thin sheet with the total thickness of 0.05~5 mm by processing methods such as twin-screw extrusion and rolling, then, the thin sheet as shown in FIG. 7B is formed by the hot pressing method, the feature of the thin sheet obtained by the above processes is that one metal foil 3 with double matt sides is sandwiched between the above-mentioned upper and lower conductive polymer chips 1 with PTC property and coated evenly on the lower and upper surfaces of them respectively; two metal foils 2 with single matt side are laminated evenly on the upper and lower surfaces of the two conductive polymer chips 1; the insulating films 4 are coated tightly on the above-mentioned two metal foils 2 with single matt side;

(2) Two layers of insulating glue 6 are coated on the left and right sides of the above-mentioned thin sheet respectively and solidified, to form four insulating coating layers on four sides of the thin sheet, so as to form the thin sheet, as shown in FIG. 6C;

(3) On the left side and the right side of the above-mentioned thin sheet, the surfaces of the outside insulating coating layers are grooved through physical processing methods (such as laser processing, etc.), to expose the inner metal foils partially, to form the thin sheet with three physical processing areas, the feature of the physical processing areas of the thin sheet is that there are two areas at the right side and one area at the left side;

(4) After two sides of the above-mentioned thin sheet are sheathed with the U-shaped thin-wall slots (please refer to FIG. 6E), the U-shaped thin-wall slots are connected with the PTC metal foils by methods such as welding, to from the bar-shaped thin sheet having the conductive metal layers 7, as shown in FIG. 6F, and its process is shown in FIG. 6E;

(5) The above-mentioned bar-shaped thin sheet is cut into single SMD-type elements with prescribed size, as shown in FIG. 6A.

Embodiment 7

The laminated SMD-type thermistor with PTC property and manufacturing method thereof of Embodiment 7 of the present invention are exemplified by reference to FIG. 7A~FIG. 7E.

FIG. 7A is the structure view of the laminated SMD-type thermistor with PTC property of Embodiment 7 of the present invention.

In FIG. 7A, the conductive polymer chip 1 with PTC property is a macromolecular polymer sheet formed by a mixture including one or more crystalline polymers, conductive fillers, processing aids and so on; one metal foil 3 with double matt sides is sandwiched between the above-mentioned upper and lower conductive polymer chips 1 with PTC property and coated evenly on the lower and upper surfaces of them respectively; two metal foils 2 with single matt side are coated evenly on the upper and lower surfaces of the above-mentioned two conductive polymer chips 1 with PTC property; the insulating films 4 are coated tightly and evenly on the surfaces of the above-mentioned two metal foils 2 with single matt side, the insulating films 4 on the two metal foils 2 with single matt side are divided into two parts totally; the insulating glue 6 is coated on the left and right sides of the above-mentioned assembly, there are three physical processing grooving areas with groove are existed in the gaps between the insulating films 4, the insulating glue 6 and the metal foils, wherein there are two areas at the left side and one area at the right side; the conductive metal layers 5 at the left and right ends and parts of the upper and lower surfaces are attached well to the surfaces of the insulating films 4, the insulating glue 6 and the metal foils 2 in the physical processing grooving areas with groove, making the conductive metal layers 5 and the above-mentioned metal foils maintain a good electrical connection; the plating resistant films 8 are pasted evenly and tightly on the middle areas of the upper and lower surfaces of the above-mentioned insulating films 4, and the plating resistant films 8 on the upper and lower surfaces are divided into two parts totally;

The manufacturing method of the laminated SMD-type thermistor with PTC property of Embodiment 7 of the present invention is exemplified by reference to FIG. 7A~FIG. 7E.

Figure 7C:
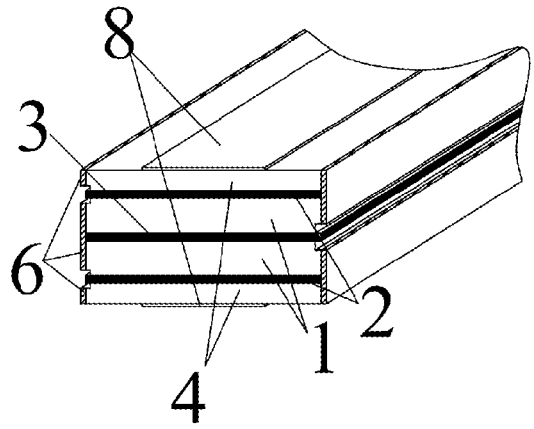
Figure 7D:
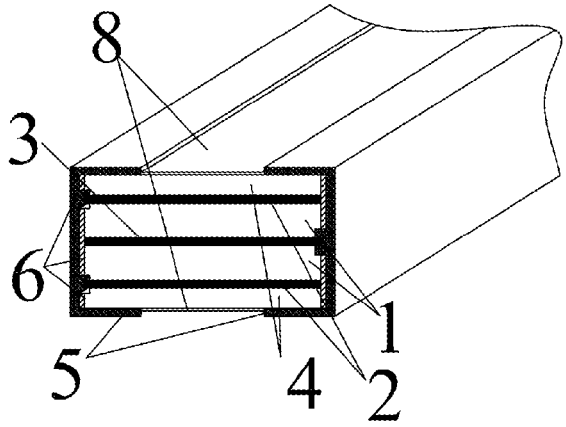
Figure 7E:
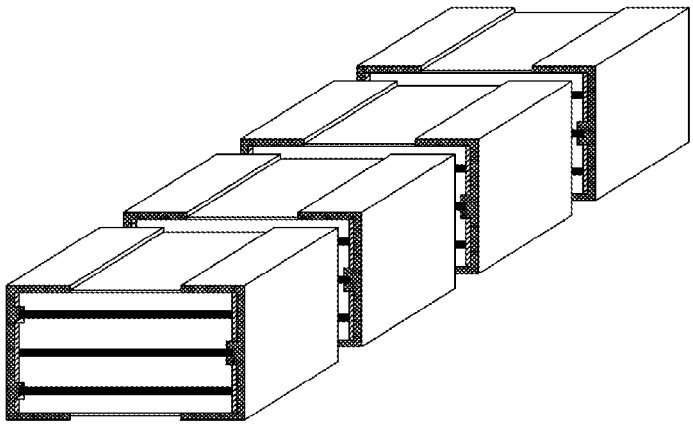

(1) The same processes corresponding to FIG. 6B~6D of Embodiment 6 are used, to form the thin sheet, as shown in FIG. 7B;

(2) Two plating resistant films 8 are applied on the middle areas of the upper and lower surfaces of the above-mentioned thin sheet, to form the laminated thin sheet, as shown in FIG. 7C;

(3) The above-mentioned thin sheet is plated as a whole, to from the bar-shaped thin sheet having the conductive metal layers 5, as shown in FIG. 7D;

(4) The above-mentioned bar-shaped thin sheet is cut into single SMD-type elements with prescribed size, as shown in FIG. 7A, please refer to FIG. 7E for the procedure.

The sequence of some processes (such as the process of grooving through physical processing and the process of applying the plating resistant films 8) in the above-mentioned various processes can be changed, as long as they do not affect the manufacturing of the SMD-type thermistor with PTC property.

Embodiment 8

The laminated SMD-type thermistor with PTC property and manufacturing method thereof of Embodiment 8 of the present invention are exemplified by reference to FIG. 8A~FIG. 8E.

Figure 8A:
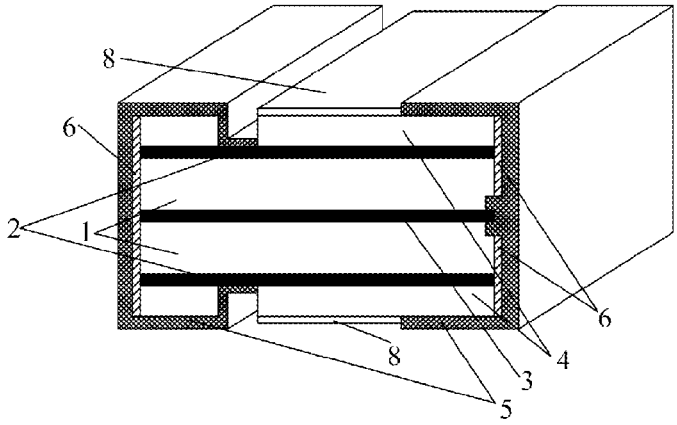
FIG. 8A is a schematic three-dimensional view of an eighth embodiment of the laminated SMD-type thermistor of the present invention.

FIG. 8A is the structure view of the laminated SMD-type thermistor with PTC property of Embodiment 8 of the present invention.

In FIG. 8A, the conductive polymer chip 1 with PTC property is a macromolecular polymer sheet formed by a mixture including one or more crystalline polymers, conductive fillers, processing aids and so on; one metal foil 3 with double matt sides is sandwiched between the above-mentioned upper and lower conductive polymer chips 1 with PTC property and coated evenly on the lower and upper surfaces of them respectively; two metal foils 2 with single matt side are coated evenly on the upper and lower surfaces of the above-mentioned two conductive polymer chips 1 with PTC property; the insulating films 4 are coated tightly and evenly on the surfaces of the above-mentioned two metal foils 2 with single matt side, the insulating films 4 on the above-mentioned two metal foils 2 with single matt side are divided into four parts totally; the insulating glue 6 is coated on the left and right sides, there are three physical processing grooving areas with groove existed in the gaps between the insulating films 4 on the upper and lower sides, the insulating glue 6 at the left and right sides, and the above-mentioned metal foil with double matt sides and the above-mentioned metal foils with single matt side, wherein there is one area at each of the upper and lower surfaces and one area at the right side; the conductive metal layers 5 at the left and right ends and parts of the upper and lower surfaces are attached well to the surfaces of the insulating films 4, the insulating glue 6 and the metal foils in the physical processing grooving area with groove, making the conductive metal layers 5 and the above-mentioned metal foils maintain a good electrical connection; the plating resistant films 8 are coated tightly and evenly on the middle areas of the upper and lower surfaces of the above-mentioned insulating films 4, and the plating resistant films 8 on the upper and lower surfaces are divided into two parts totally.

The manufacturing method of the laminated SMD-type thermistor with PTC property of Embodiment 8 of the present invention is exemplified by reference to FIG. 8B~FIG. 8E.

Figure 8B:
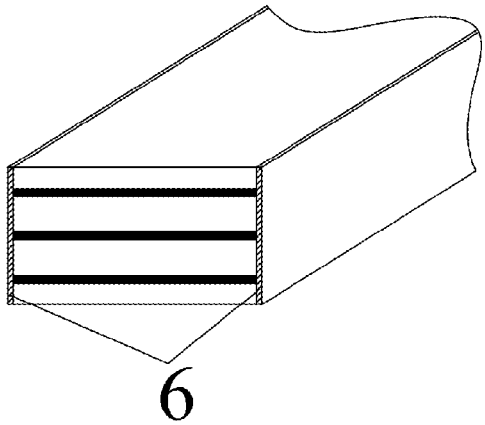
FIG. 8B~FIG. 8E are schematic views of the manufacturing process of the eighth embodiment shown in FIG. 8A.
Figure 8C:
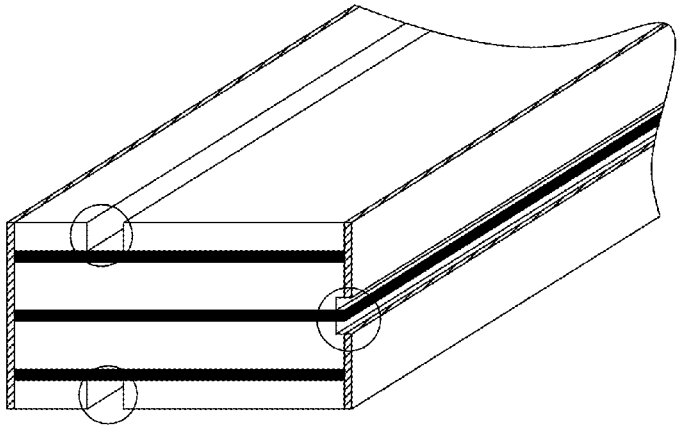
Figure 8D:
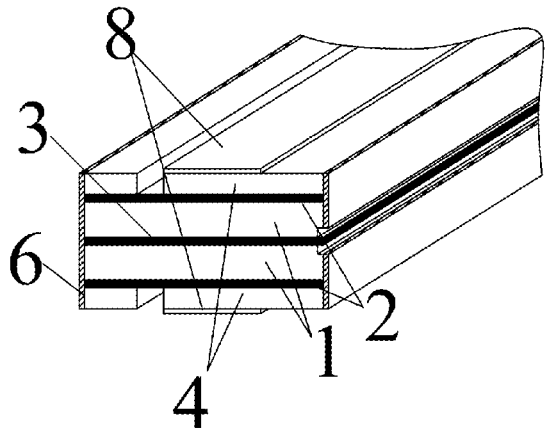
Figure 8E:
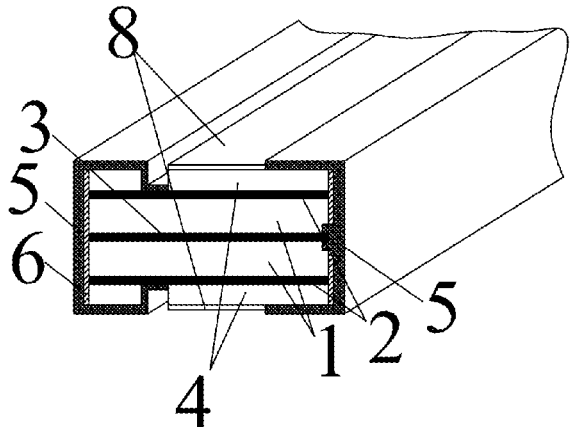

(1) The same processes corresponding to FIG. 6B~6C of Embodiment 6 are used, to form four insulating coating layers on four sides of the thin sheet, so as to form the thin sheet, as shown in FIG. 8B;

(2) On the left side and the right side of the above-mentioned laminated thin sheet, the surfaces of the outside insulating coating layers are grooved through physical processing methods (such as laser processing, etc.), to expose the inner metal foils partially, to form the laminated thin sheet with three physical processing grooving areas (one on each of the upper and lower surfaces, one on the right side), as shown in FIG. 8C;

(3) Two plating resistant films 8 are applied on the middle areas of the upper and lower surfaces of the above-mentioned thin sheet, to form the laminated thin sheet, as shown in FIG. 8D;

(4) The above-mentioned thin sheet is plated as a whole, to from the laminated thin sheet having the conductive metal layers 5, as shown in FIG. 8E;

Finally, the above-mentioned laminated bar-shaped thin sheet is cut into single SMD-type elements with prescribed size, as shown in FIG. 8A.

Similar to Embodiment 6 and Embodiment 7, here, after the process of grooving through physical processing as shown in FIG. 8C, the following processes can be conducted:

After two sides of the conductive module obtained by grooving through physical processing are sheathed with the U-shaped thin-wall slots, the U-shaped thin-wall slots are connected with the PTC metal foils by methods such as welding; finally, the above-mentioned bar-shaped thin sheet formed is cut into single SMD-type elements with prescribed size. In this case, there are no above-mentioned upper and lower plating resistant films 8 as shown in FIG. 8A in the structure of the element obtained.

Similar to the innovative structures of the laminated SMD-type thermistors with PTC property and manufacturing methods thereof of the above-mentioned various embodiments, two, three or more layers of the laminated SMD-type thermistors with PTC property are also in the protection scope of the present invention.

With the above-mentioned laminated SMD-type thermistor and manufacturing method thereof, the laminated SMD-type thermistor has a novel structure, a superior performance, a high rate of qualified products and a unique manufacturing process, with the manufacturing method, the etching process is not needed to be performed on the surfaces of the metal foils, only the physical processing (e.g. laser vaporization) process is performed on two layers of insulating glue (or two insulating films, or one layer of insulating glue and one insulating film) of the conductive module formed having the insulating layer on the upper, lower, left and right surfaces, to expose the metal foils partially and connect them with two plated metal layers coated outside respectively. Compared with the traditional process, the above-mentioned laminated SMD-type thermistor and manufacturing method thereof of the present invention have the following advantages:

(1) The organic particulate matters produced by grooving through physical processing (such as laser processing, etc.) can be recycled easily through sealed pipes, so it is environmentally friendly, and there is no shortcoming similar to that of the etching fluid polluting the environmental seriously;

(2) Compared with the cost of chemical etching (for single layer PTC element, the cost is about 0.08 yuan/piece, for multi-layer PTC element, the cost doubles), the grooving cost (for single layer PTC element, the cost is about 0.01 yuan/piece, for multi-layer PTC element, the cost increases less) through the physical processing (e.g., laser processing, etc.) is lower, thus saving a lot of production costs;

(3) it is uneasy to produce abnormal defects similar to those such as shift, dislocation and so on that are produced easily for the etching pattern, thus the grooving process through physical processing (e.g., laser processing, etc.) is more stable;

(4) the accuracy of grooving through physical processing is high, for example, the straight line accuracy of physical processing and so on can be up to 0.05 mm, the width of laser processing also can reach 0.05 mm, the yield rate is higher than that of the traditional process;

(5) The materials required in forming the element are relatively few, making the total cost of the raw materials less than that of the traditional structure;

(6) For the materials are relatively few, the manufacturing processes required are relatively few, making the total rate of finished products relatively high;

(7) For the roughness of the surfaces of the metal foil with double matt sides is relatively large, the adhesive force for combining the PTC chip is relatively big, making the combination of the materials more compact, and for the materials are relatively few, the rate to produce abnormal phenomena such as shift, dislocation and so on during carrying out processes such as hot-processing and so on is relatively small, to make the structure more stable and reliable.

In the present specification, the present invention has been described according to the particular embodiments. But it is obvious that these embodiments can be modified or changed without departure from the spirit and scope of the present invention. Therefore, the specification and drawings described above are exemplary only and not intended to be limiting.

What is claimed is:

1. A laminated SMD-type thermistor, comprising:

a multi-part conductive module, the multi-part conductive module including a core conductive module including a conductive unit which includes an upper metal foil, a conductive polymer chip with a PTC property, and a lower metal foil, wherein the upper metal foil, the conductive polymer chip and the lower metal foil are laminated in sequence from a top to a bottom of the core conductive module, and a multi-layer insulating layer, the multi-layer insulating layer including an upper insulating layer, a lower insulating layer, a left insulating layer, and a right insulating layer, wherein the upper insulating layer and the lower insulating layer are coated on the upper surface and the lower surface of the core conductive module respectively, the left insulating layer and the right insulating layer are coated on the left side and the right side of the core conductive module respectively; and a left conductive metal layer and a right conductive metal layer being coated on the left part and the right part of the multi-part conductive module respectively, wherein the left conductive metal layer electrically connects with the upper metal foil/the lower metal foil by penetrating a groove of the left insulating layer, and the right conductive metal layer electrically connects with the lower metal foil/the upper metal foil by penetrating a groove of the right insulating layer.

2. The laminated SMD-type thermistor according to claim 1, wherein the laminated SMD-type thermistor further comprises an upper plating resistant film and a lower plating resistant film, wherein the upper plating resistant film and the lower plating resistant film are coated on the upper surface and the lower surface of the multi-part conductive module respectively for separating the left conductive metal layer and the right conductive metal layer.

3. A manufacturing method of the laminated SMD-type thermistor according to claim 1, comprising the following steps:

manufacturing the conductive polymer chip;

laminating the upper metal foil and the lower metal foil on the upper surface and the lower surface of the conductive polymer chip respectively, so as to form the conductive unit;

coating the multi-layer insulating layer on the upper surface, the lower surface, the left side and the right side of the core conductive module, so as to form the multi-part conductive module;

forming grooves in the multi-layer insulating layer to form the grooves of the left and right insulating layers through physical processing methods to partially expose the upper and lower metal foils; and either one of coating the left conductive metal layer and the right conductive metal layer to the left part and the right part of the conductive module, and connecting them with the upper and lower metal foils respectively; and coating an upper plating resistant film and a lower plating resistant film on middle areas of the upper surface and the lower surface of the multi-part conductive module, then plating the thermistor as a whole, so as to form the left conductive metal layer and the right conductive metal layer to be the connected to the upper and lower metal foils.

4. The manufacturing method of the laminated SMD-type thermistor according to claim 3, wherein in the manufacturing, the conductive polymer chip is manufactured by at least one crystalline polymer, conductive fillers and processing aids mixed through twin-screw extrusion and rolling.

5. The manufacturing method of the laminated SMD-type thermistor according to claim 3, wherein the coating the multi-layer insulating layer comprises:

applying insulating glue to the left side and the right side of the core conductive module respectively; and solidifying the insulating glue so as to form the left insulating layer and the right insulating layer.

6. The manufacturing method of the laminated SMD-type thermistor according to claim 3, wherein in the forming grooves, the physical processing methods include at least a laser processing method.

7. The manufacturing method of the laminated SMD-type thermistor according to claim 3, wherein after the manufacturing and before the coating the multi-layer insulating layer, the manufacturing method of the laminated SMD-type thermistor further comprises the following step:

cutting the core conductive module into an appropriate shape.

8. A laminated SMD-type thermistor, comprising:

a multi-part conductive module, the multi-part conductive module including a core conductive module including a central metal layer, an upper metal layer, a lower metal layer, at least two conductive polymer chips that include a PTC property and are piled up in sequence, wherein adjacent ones of the conductive polymer chips each make electrical contact with the central metal layer and are separated from each other by the central metal layer, each of the adjacent conductive polymer chips having a length that is approximately equal to a length of the central metal layer, the top surface of an uppermost one of the conductive polymer chips being coated with the upper metal layer and the bottom surface of a lowermost one of the conductive polymer chips being coated with the lower metal layer, an insulating layer which is coated on the upper surface and the lower surface of the core conductive module; and a left conductive metal layer and a right conductive metal layer insulated from each other and being coated on the left part and the right part of the multi-part conductive module respectively, wherein the upper metal layer, the central metal layer and the lower metal layer being connected conductively with the left conductive metal layer and the right conductive metal layer according to a parity interval manner.

9. The laminated SMD-type thermistor according to claim 8, wherein the insulating layer is a multi-layer insulating layer that includes an upper insulating layer and a lower insulating layer, the upper insulating layer and the lower insulating layer being coated on the upper surface and the lower surface of the core conductive module respectively.

10. The laminated SMD-type thermistor according to claim 9, wherein the multi-layer insulating layer further includes a left insulating layer and a right insulating layer, the left insulating layer and the right insulating layer being coated on the left side and the right side of the core conductive module respectively, the left conductive metal layer is coated on the outside of the left insulating layer, the left conductive metal layer penetrates the left insulating layer partially, so as to be connected conductively with corresponding parts of the upper metal layer, the central metal layer and the lower metal layer, the right conductive metal layer is coated on the outside of the right insulating layer, and the right conductive metal layer penetrates the right insulating layer partially, so as to be connected conductively with corresponding parts of the upper metal layer, the central metal layer and the lower metal layer.

11. The laminated SMD-type thermistor according to claim 9, wherein the number of the conductive polymer chips is an even number.

12. The laminated SMD-type thermistor according to claim 11, wherein the multi-layer insulating layer further includes a left insulating layer and a right insulating layer, the left insulating layer and the right insulating layer being coated on the left side and the right side of the core conductive module respectively, the left conductive metal layer is coated on the outside of the left insulating layer, the left conductive metal layer penetrates the left insulating layer partially so as to be connected conductively with a corresponding part of the central metal layer, the right conductive metal layer is coated on the outside of the right insulating layer, the right conductive metal layer penetrates the right insulating layer partially so as to be connected conductively with a corresponding part of the central metal layer, and the left conductive metal layer penetrates the upper insulating layer and the lower insulating layer partially so as to be connected conductively with the upper metal layer and the lower metal layer respectively.

13. The laminated SMD-type thermistor according to claim 9, wherein the number of the conductive polymer chips is an odd number.

14. The laminated SMD-type thermistor according to claim 13, wherein the insulating layer further includes a left insulating layer and a right insulating layer, the left insulating layer and the right insulating layer being coated on the left side and the right side of the core conductive module respectively, the left conductive metal layer is coated on the outside of the left insulating layer, the left conductive metal layer penetrates the left insulating layer partially so as to be connected conductively with a corresponding part of the central metal layer, the right conductive metal layer is coated on the outside of the right insulating layer, the right conductive metal layer penetrates the right insulating layer partially, so as to be connected conductively with a corresponding part of the central metal layer, the left conductive metal layer penetrates the upper insulating layer partially so as to be connected conductively with the upper metal layer, and the right conductive metal layer penetrates the lower insulating layer partially so as to be connected conductively with the lower metal layer.

15. The laminated SMD-type thermistor according to claim 8, wherein the laminated SMD-type thermistor further comprises an upper plating resistant film and a lower plating resistant film, wherein the upper plating resistant film and the lower plating resistant film are coated on the upper surface and the lower surface of the multi-part conductive module respectively for separating and insulating the left conductive metal layer and the right conductive metal layer from each other.

16. The laminated SMD-type thermistor according to claim 8, wherein the central metal layer is a metal foil with double matt sides.

17. The laminated SMD-type thermistor according to claim 8, wherein the upper metal layer and the lower metal layer are metal foils each with a single matt side, and the single matt side of the upper metal layer being coated on the top surface of the uppermost conductive polymer chip and the single matt side of the lower metal layer being coated on the bottom surface of the lowermost conductive polymer chip.

18. A manufacturing method of the laminated SMD-type thermistor according to claim 8, comprising the following steps:

manufacturing the at least two conductive polymer chip;

piling up the conductive polymer chips while separating the adjacent ones of the conductive polymer chips with the central metal layer;

coating the upper metal layer on the top surface of the uppermost conductive polymer chip;

coating the lower metal layer the bottom surface of the lowermost conductive polymer chip;

coating the insulating layer on the upper surface, the lower surface, the left side and the right side of the core conductive module, so as to form the multi-part conductive module;

forming grooves in the insulating layer through physical processing methods to expose the central metal layer, the upper metal layer and the lower metal layer partially;

coating the left conductive metal layer and the right conductive metal layer on the left part and the right part of the multi-part conductive module; and either one of connecting conductively and respectively the upper metal layer, the central metal layer and the lower metal layer with the left conductive metal layer and the right conductive metal layer according to the parity interval manner; and coating an upper plating resistant film and a lower plating resistant film on middle areas of the upper surface and the lower surface of the multi-part conductive module, then plating the thermistor as a whole, so as to form the left conductive metal layer and the right conductive metal layer to be connected with the upper metal layer, the central metal layer and the lower metal layer according to the parity interval manner.

19. The manufacturing method of the laminated SMD-type thermistor according to claim 18, wherein in the manufacturing, the conductive polymer chips are manufactured by at least one crystalline polymer, conductive fillers and processing aids mixed through twin-screw extrusion and rolling.

20. The manufacturing method of the laminated SMD-type thermistor according to claim 18, wherein in the coating the insulating layer, the insulating layer is formed so as to include an upper insulating layer, a lower insulating layer, a left insulating layer and a right insulating layer, the upper insulating layer and the lower insulating layer are coated on the upper surface and the lower surface of the core conductive module respectively, the left insulating layer and the right insulating layer are coated on the left side and the right side of the core conductive module respectively.

21. The manufacturing method of the laminated SMD-type thermistor according to claim 20, wherein in the coating the insulating layer, insulating glue is applied on the left side and the right side of the core conductive module respectively, so as to form the left insulating layer and the right insulating layer.

22. The manufacturing method of the laminated SMD-type thermistor according to claim 18, wherein in the forming grooves, the physical processing methods include at least a laser processing method.

23. The manufacturing method of the laminated SMD-type thermistor according to claim 18, wherein after the manufacturing and before the coating the insulating layer, the manufacturing method of the above-mentioned laminated SMD-type thermistor further comprises the following step:

cutting the core conductive module into an appropriate shape.

24. The laminated SMD-type thermistor according to claim 8, wherein the insulating layer further includes a left insulating layer and a right insulating layer, the left insulating layer and the right insulating layer being coated on the left side and the right side of the core conductive module respectively, wherein in a cross-sectional view, a surface of the left insulating layer and a surface of the right insulating layer are separated from each other by a distance and the surfaces of the left and right insulating layers are parallel, a length of the central metal layer in the cross-sectional view is greater than a length of the distance.

* * * * *